US011408668B2

(12) United States Patent
Yang et al.

(10) Patent No.: US 11,408,668 B2
(45) Date of Patent: Aug. 9, 2022

(54) REFRIGERATOR

(71) Applicant: LG Electronics Inc., Seoul (KR)

(72) Inventors: Changwoan Yang, Seoul (KR); Seungjin Choi, Seoul (KR); Hanhyo Kim, Seoul (KR); Yoomin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/720,622

(22) Filed: Dec. 19, 2019

(65) Prior Publication Data

US 2020/0200469 A1 Jun. 25, 2020

Related U.S. Application Data

(63) Continuation of application No. 16/272,423, filed on Feb. 11, 2019, now Pat. No. 10,520,247, which is a (Continued)

(51) Int. Cl.
*F25D 25/02* (2006.01)
*F25D 23/06* (2006.01)
(Continued)

(52) U.S. Cl.
CPC ..... *F25D 25/025* (2013.01); *A47B 88/417* (2017.01); *A47B 96/16* (2013.01);
(Continued)

(58) Field of Classification Search
CPC .... F25D 25/025; F25D 23/062; F25D 23/068; F25D 23/067; F25D 23/028; F25D 23/02;
(Continued)

(56) References Cited

U.S. PATENT DOCUMENTS 1,227,813 A * 5/1917 Mahoney ..... A47B 96/16 312/274
1,835,847 A * 12/1931 Chandler ..... F25D 25/02 62/265
(Continued)

FOREIGN PATENT DOCUMENTS

JP 2008196839 A * 8/2008

*Primary Examiner* — Hanh V Tran
(74) *Attorney, Agent, or Firm* — Fish & Richardson P.C.

(57) ABSTRACT

A refrigerator of the present invention comprises: a cabinet that includes a storage compartment having an opening formed on the front side thereof; a door rotatably connected to the cabinet to open and close the opening; a drawer disposed within the storage compartment to accommodate stored goods therein; a drawer guide that supports the drawer and guides the drawer in order to enable the drawer to move forward and rearward; an extraction mechanism that includes a base part that is disposed below the drawer and moves forward while the door is opened and rearward while the door is closed, a rear frame that extends from the base part toward the rear side of the drawer and pushes the drawer forward when the base part moves forward, and an arm that extends forward from the rear frame and is disposed between the drawer and a side of the storage compartment; and an arm guide disposed between the side of the storage compartment and the drawer to guide the arm in order to enable the arm to move forward and rearward.

12 Claims, 15 Drawing Sheets

Related U.S. Application Data continuation of application No. 15/550,518, filed as application No. PCT/KR2016/001455 on Feb. 12, 2016, now Pat. No. 10,203,152.

(51) Int. Cl.
*A47B 96/16* (2006.01)
*F25D 23/02* (2006.01)
*A47B 88/417* (2017.01)
*A47B 88/493* (2017.01)

(52) U.S. Cl.
CPC ..... *F25D 23/02* (2013.01); *F25D 23/028* (2013.01); *F25D 23/062* (2013.01); *F25D 23/067* (2013.01); *F25D 23/068* (2013.01); *A47B 88/493* (2017.01); *A47B 2210/0059* (2013.01); *A47B 2210/175* (2013.01); *F25D 2323/024* (2013.01)

(58) Field of Classification Search
CPC . F25D 2323/024; A47B 88/417; A47B 96/16; A47B 88/493; A47B 2210/175; A47B 2210/0059
See application file for complete search history.

(56) References Cited

U.S. PATENT DOCUMENTS 2,095,811 A * 10/1937 Goulooze ..... F25D 25/024 312/274
2,761,751 A * 9/1956 Stockton ..... F25D 25/024 312/274
3,212,835 A * 10/1965 Beckett ..... F25D 25/024 312/311
5,005,729 A * 4/1991 Hollman ..... A47B 77/18 220/23.83
5,299,863 A * 4/1994 Albright, Jr. ..... F25D 25/024 312/404
5,440,107 A * 8/1995 Phillips ..... G07G 1/0027 235/10
5,474,374 A * 12/1995 Sandvig ..... A47B 77/18 312/271
5,810,462 A * 9/1998 Lee ..... F25D 25/027 312/405.1
6,220,682 B1 * 4/2001 Vertullo ..... A47B 46/00 312/334.24
6,253,568 B1 * 7/2001 Peffley ..... F25D 11/02 312/199
8,267,493 B2 * 9/2012 Kim ..... F25D 25/024 312/408
9,322,592 B2 * 4/2016 Kim ..... F25D 23/02
9,726,423 B1 * 8/2017 Swarnkar ..... F25D 23/028
2005/0275326 A1 * 12/2005 Lim ..... F25D 25/024 312/408
2010/0253191 A1 * 10/2010 Backhaus ..... B01L 1/50 312/309
2010/0307186 A1 * 12/2010 Kwon ..... F25D 23/028 62/407
2011/0050065 A1 * 3/2011 Lee ..... F25D 23/028 312/402
2012/0031136 A1 * 2/2012 Park ..... F25D 25/025 62/340
2012/0079650 A1 * 4/2012 Metcalf ..... E03D 13/00 4/311
2013/0257255 A1 * 10/2013 Hwang ..... F25D 23/02 312/404
2017/0234607 A1 * 8/2017 Yang ..... F25D 11/02 312/408

* cited by examiner

【FIG. 1】
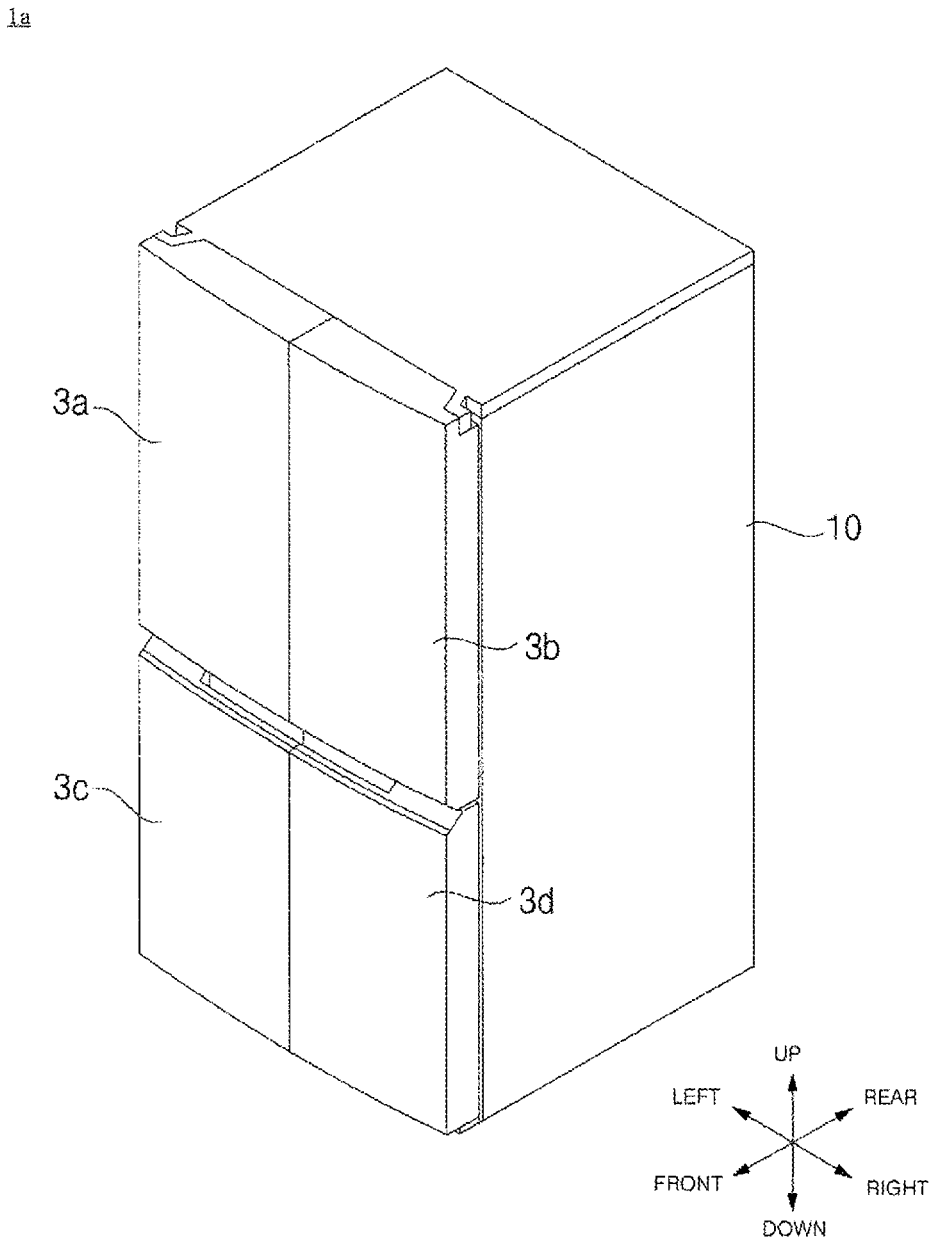

【FIG. 2】
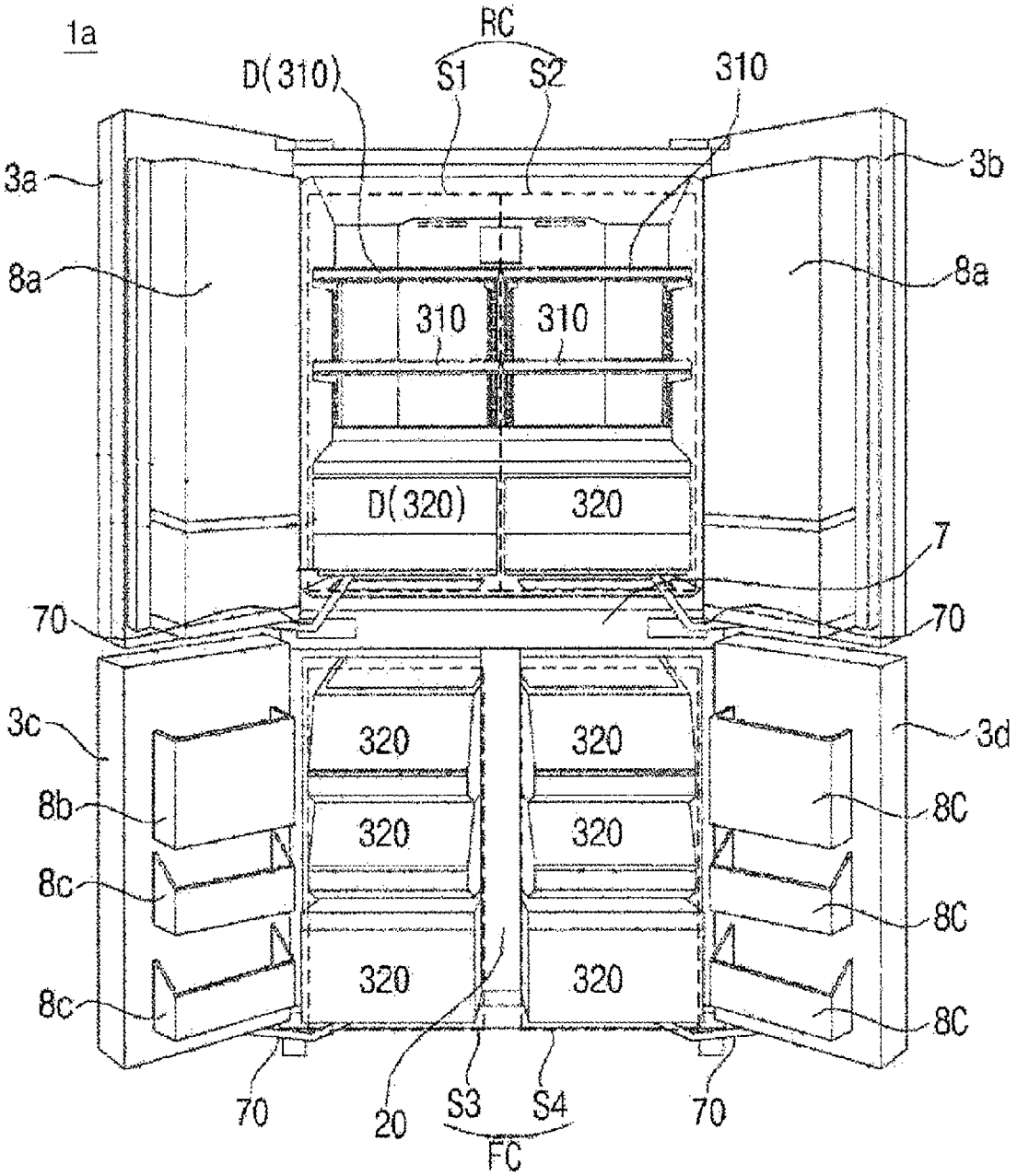

【FIG. 3】
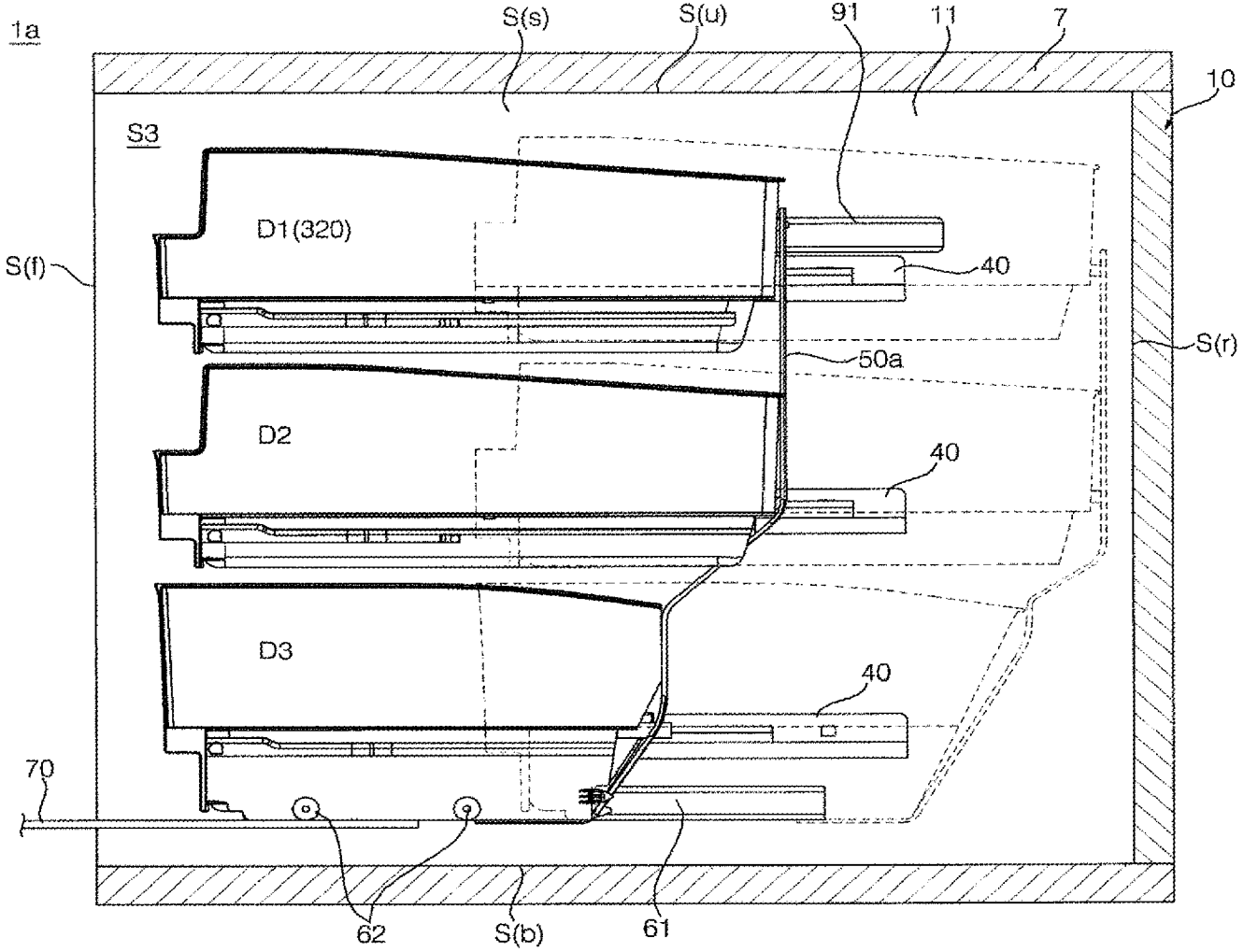

【FIG. 4】
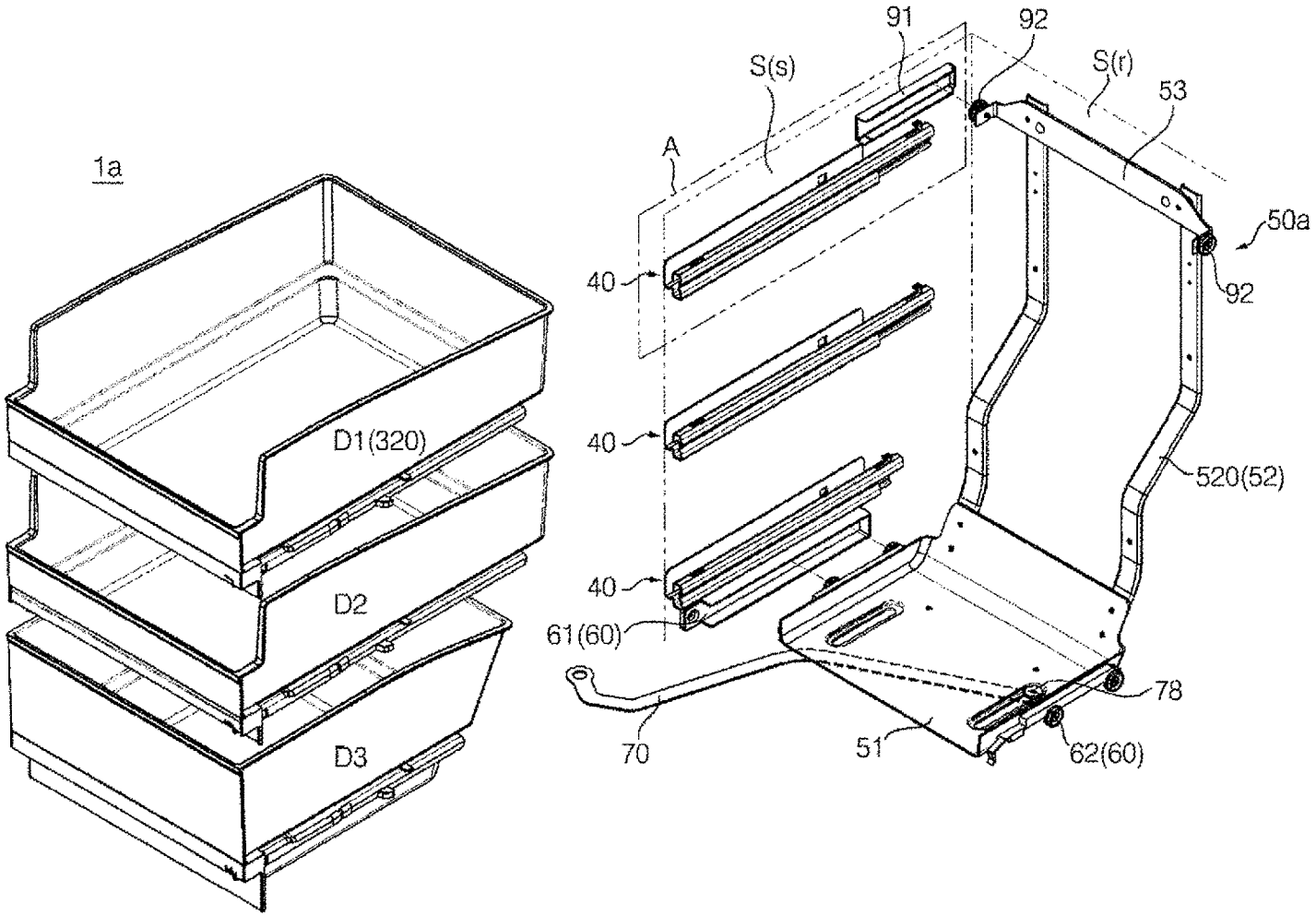

【FIG. 5】
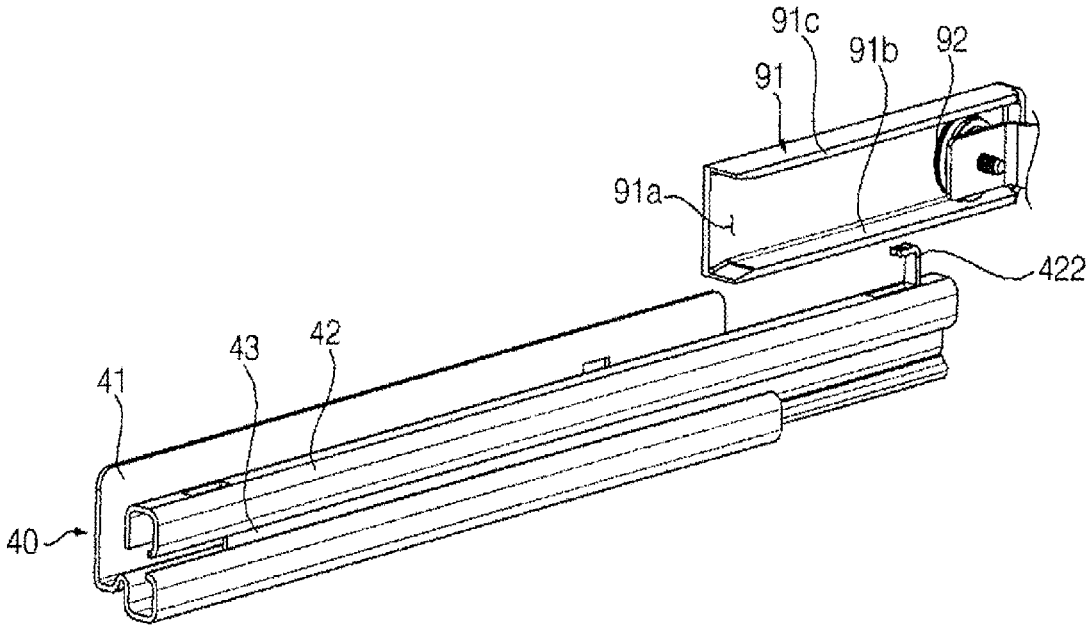
【FIG. 6】
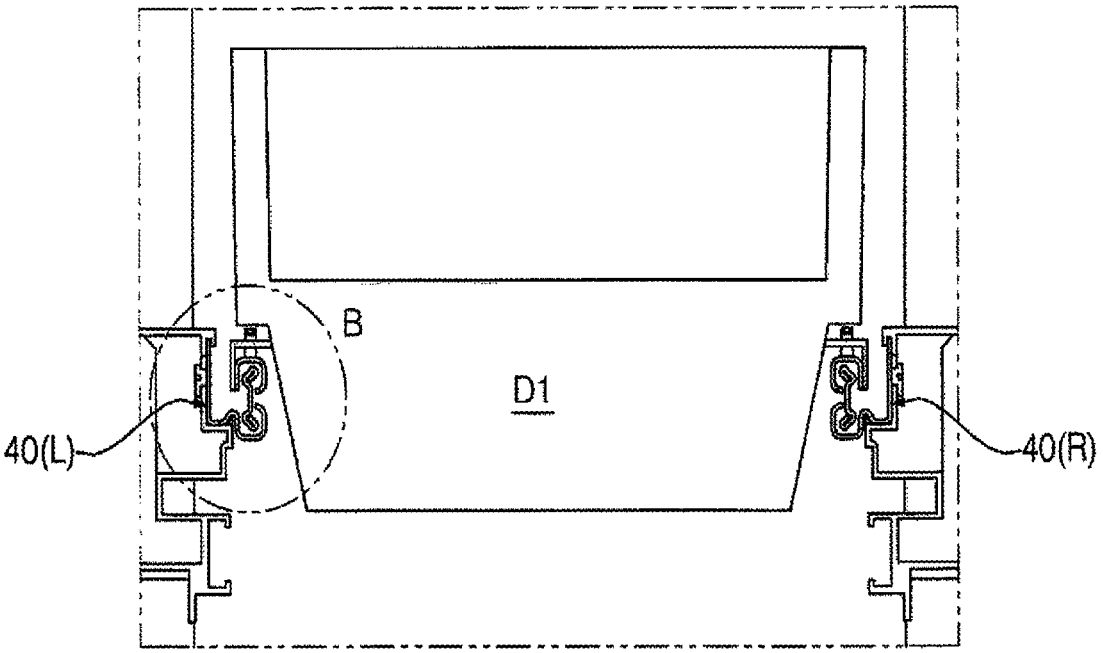

【FIG. 7】
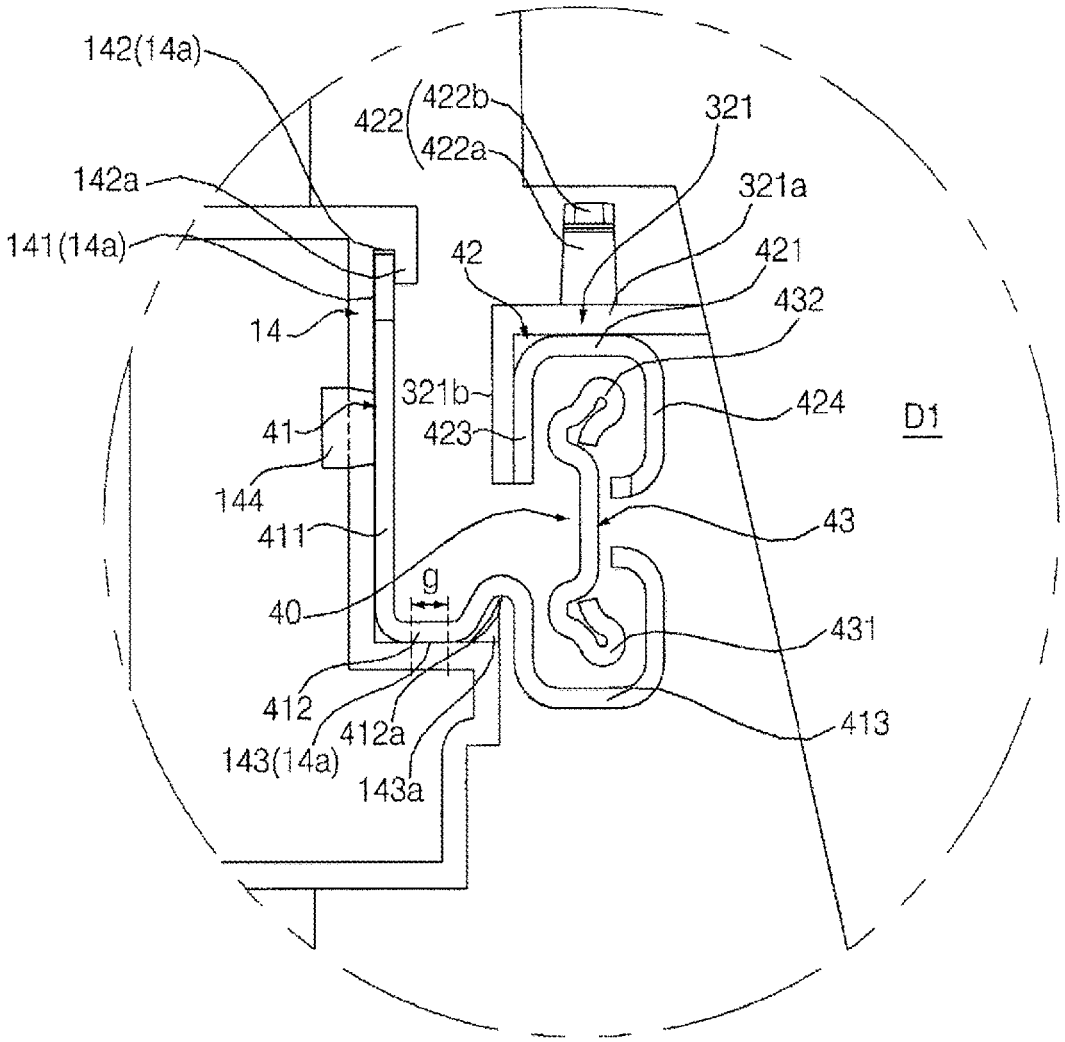

【FIG. 8】
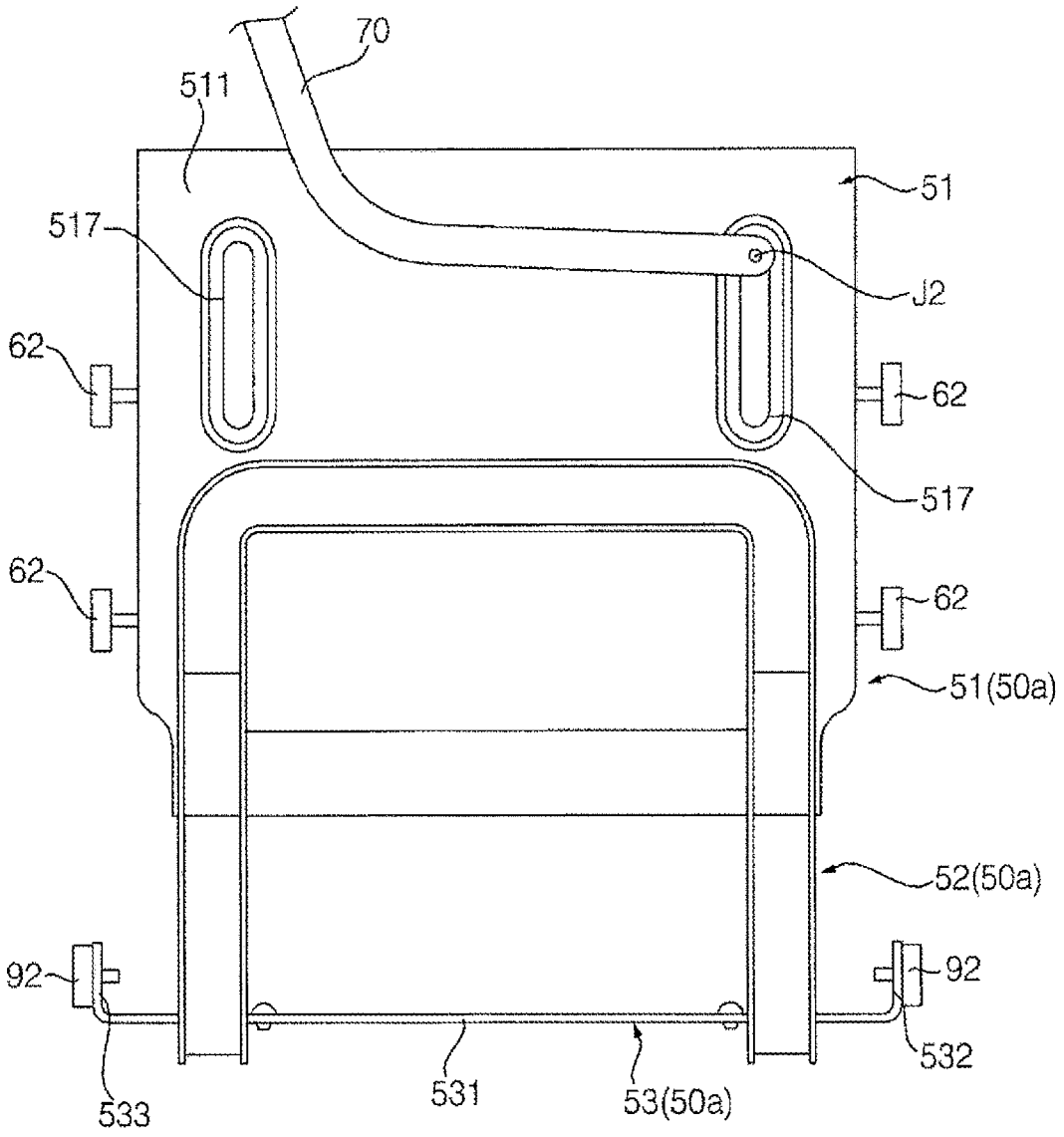

【FIG. 9a】
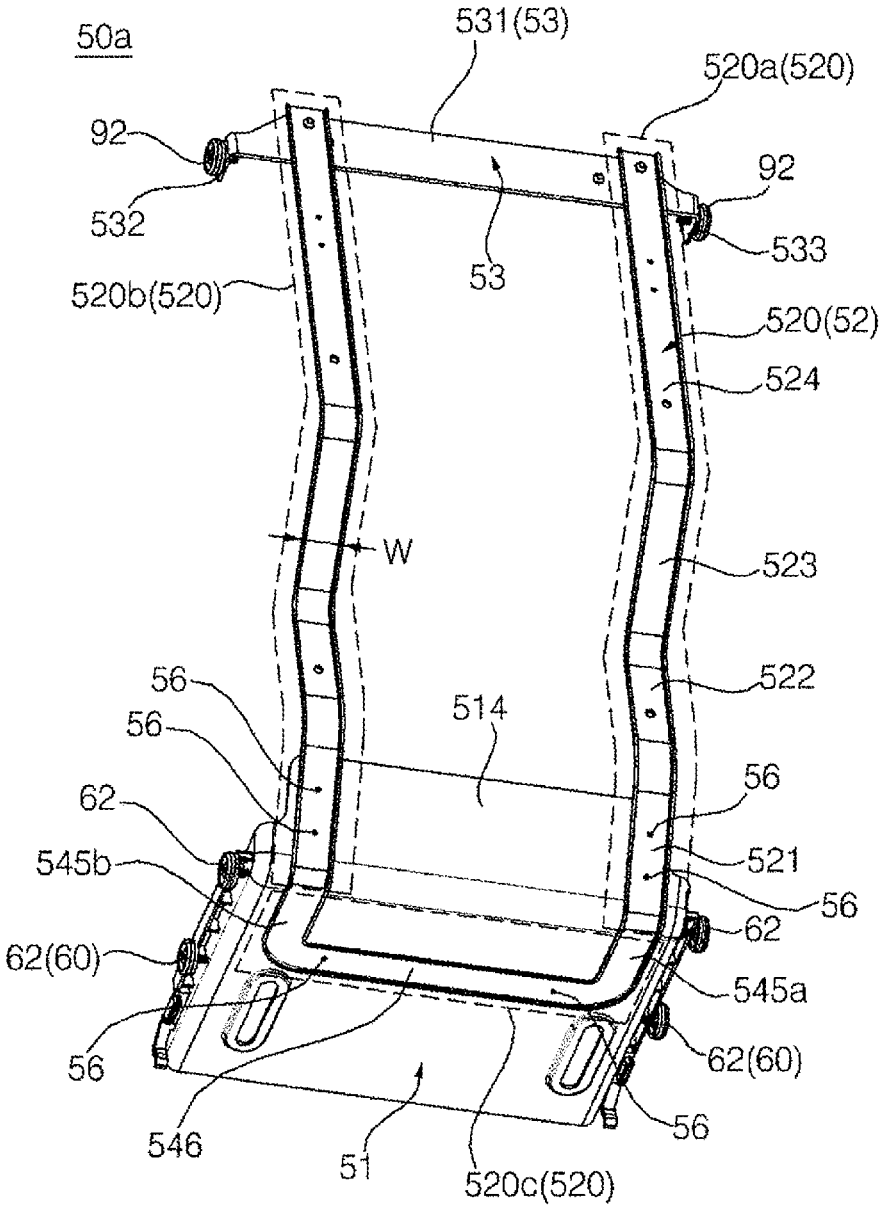

【FIG. 9b】
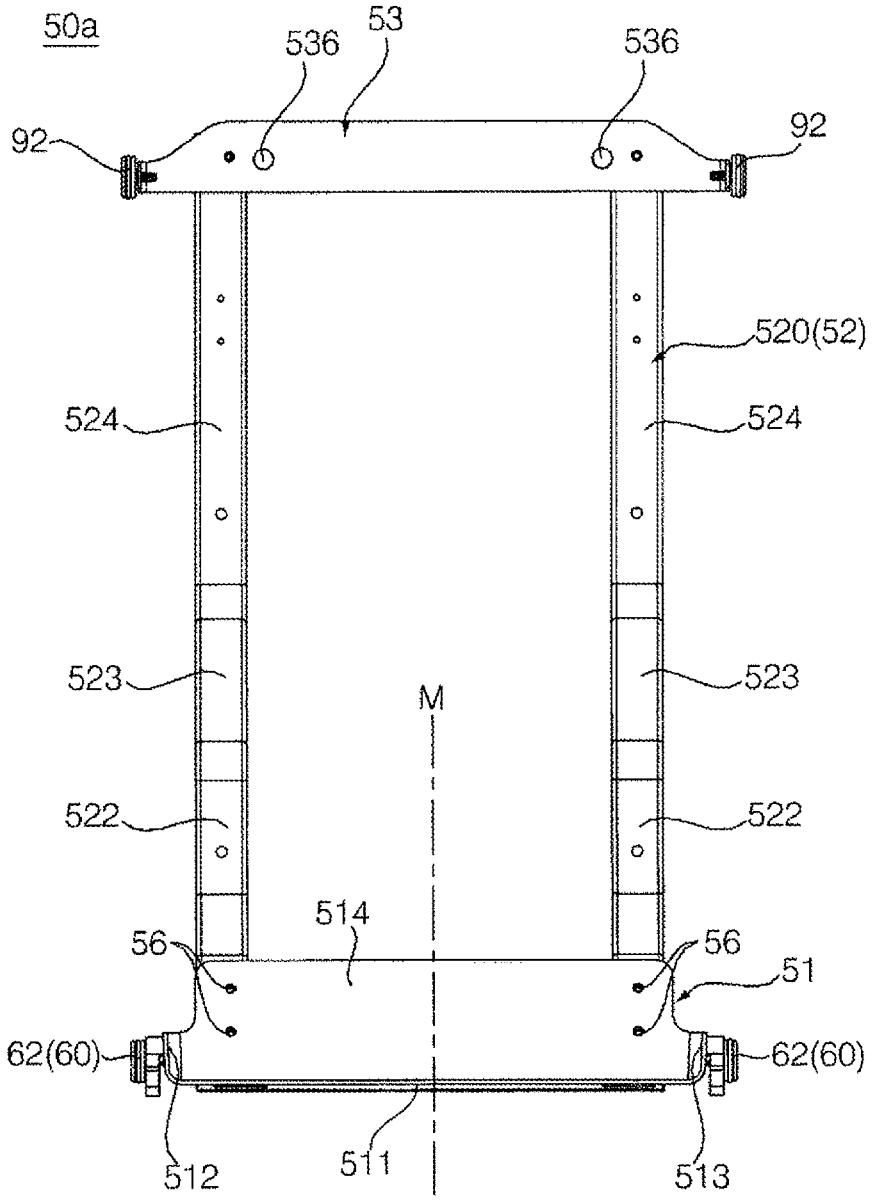

【FIG. 9c】
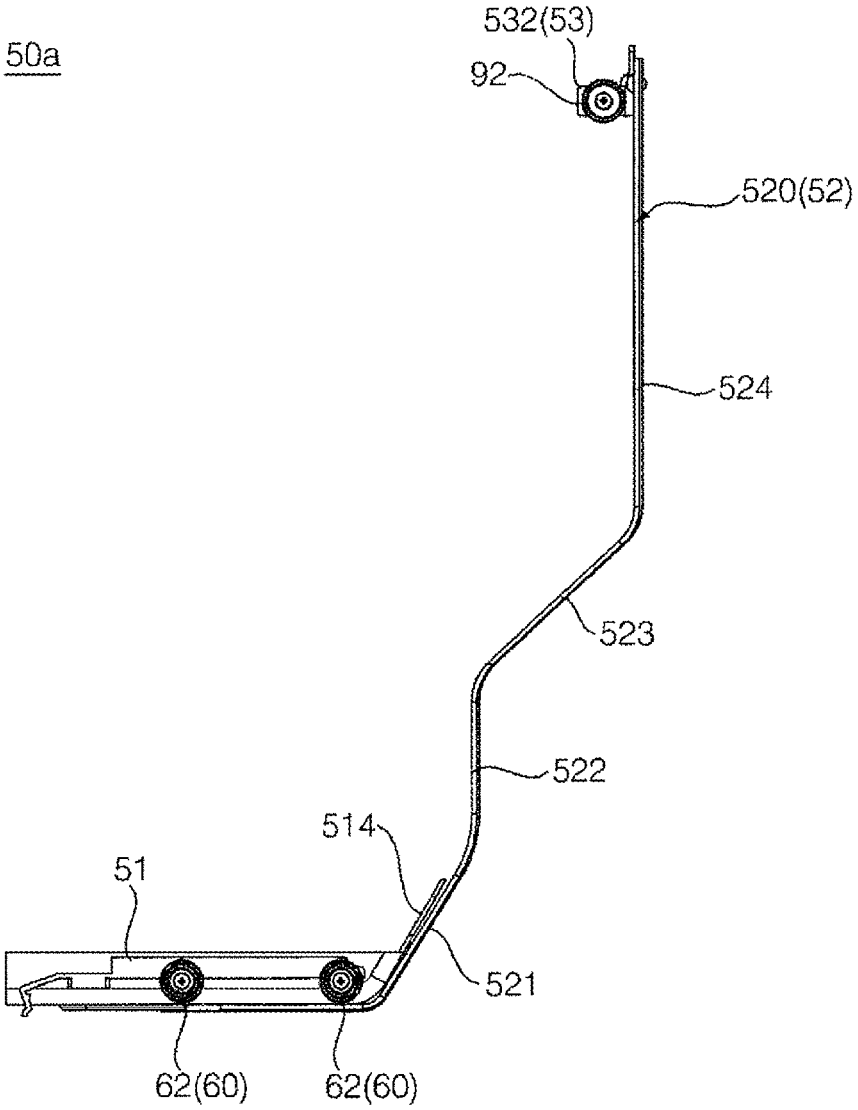

【FIG. 10a】
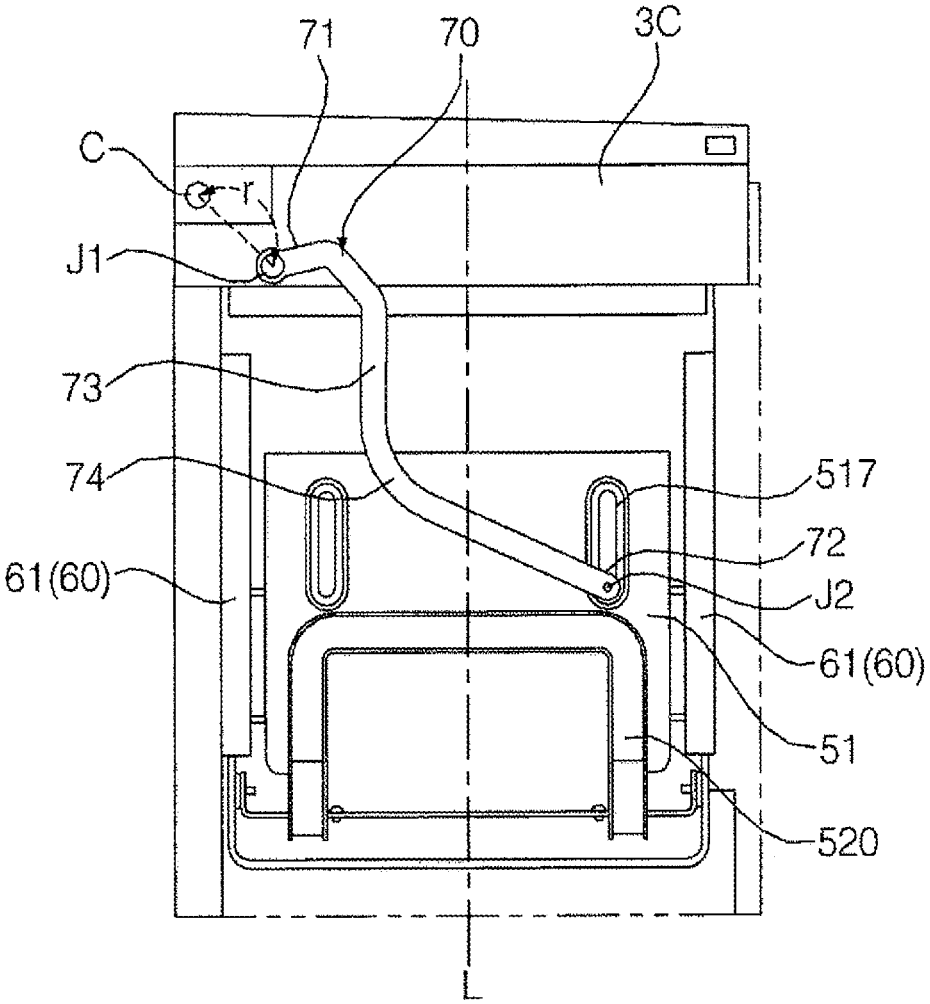

【FIG. 10b】
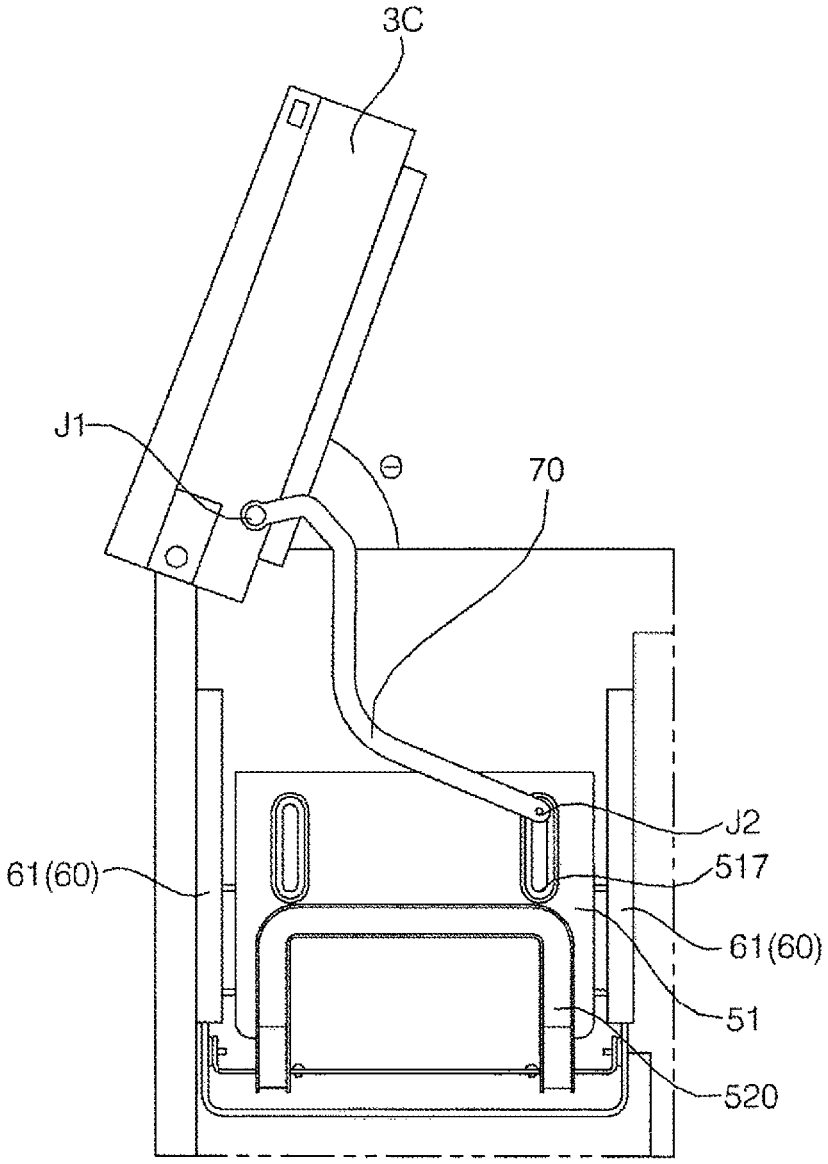

【FIG. 10c】
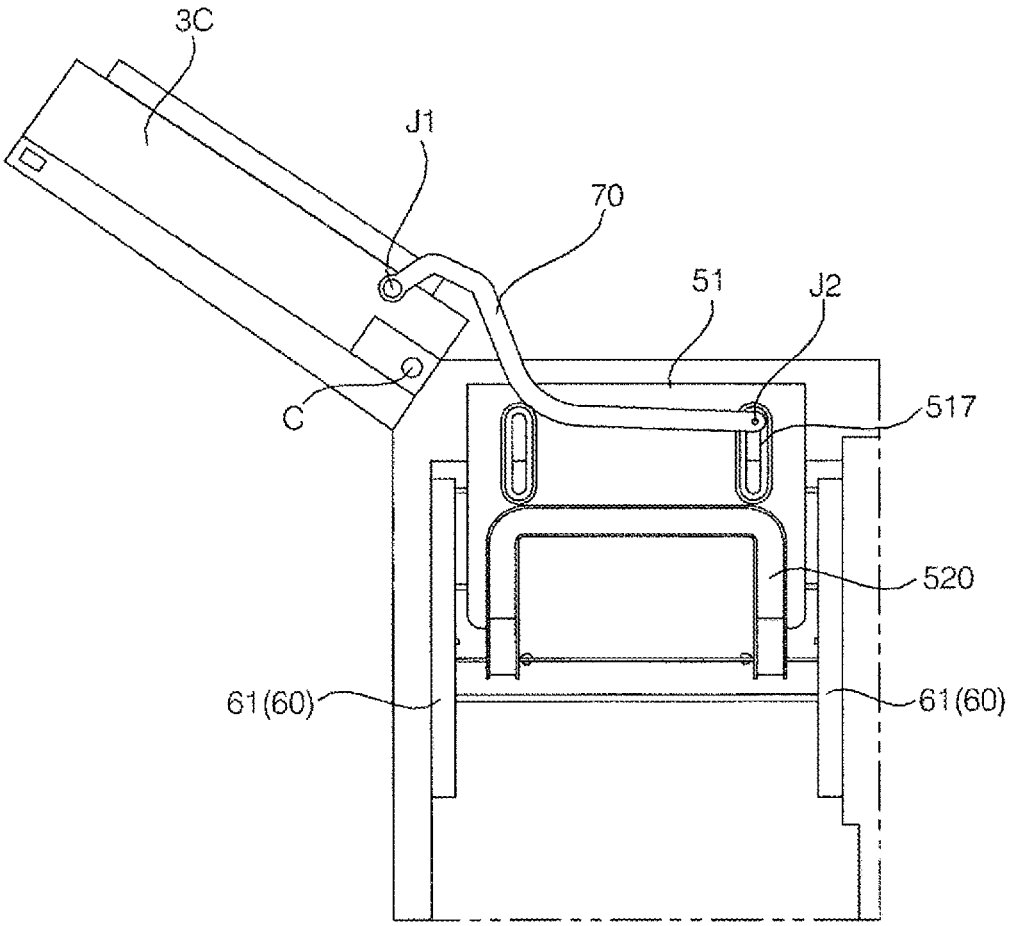

【FIG. 11】
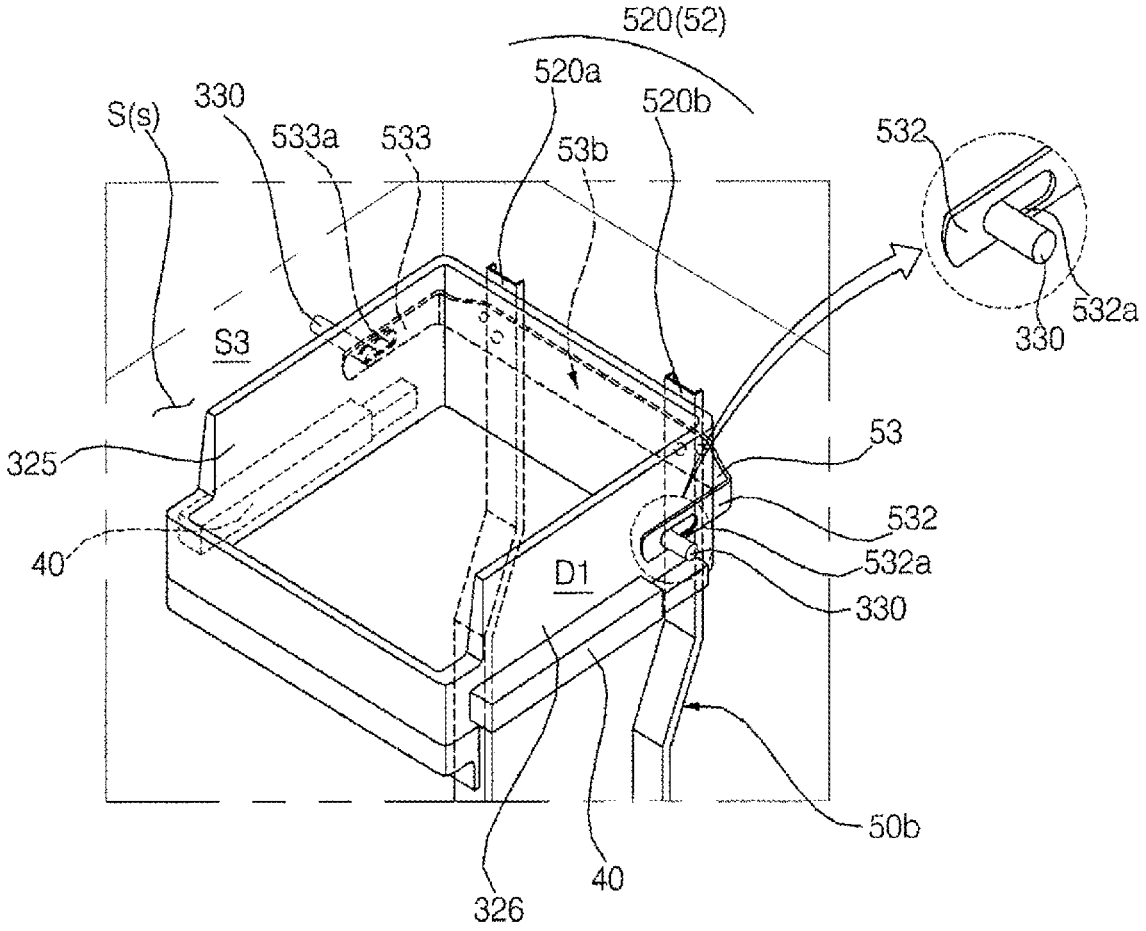

【FIG. 12】
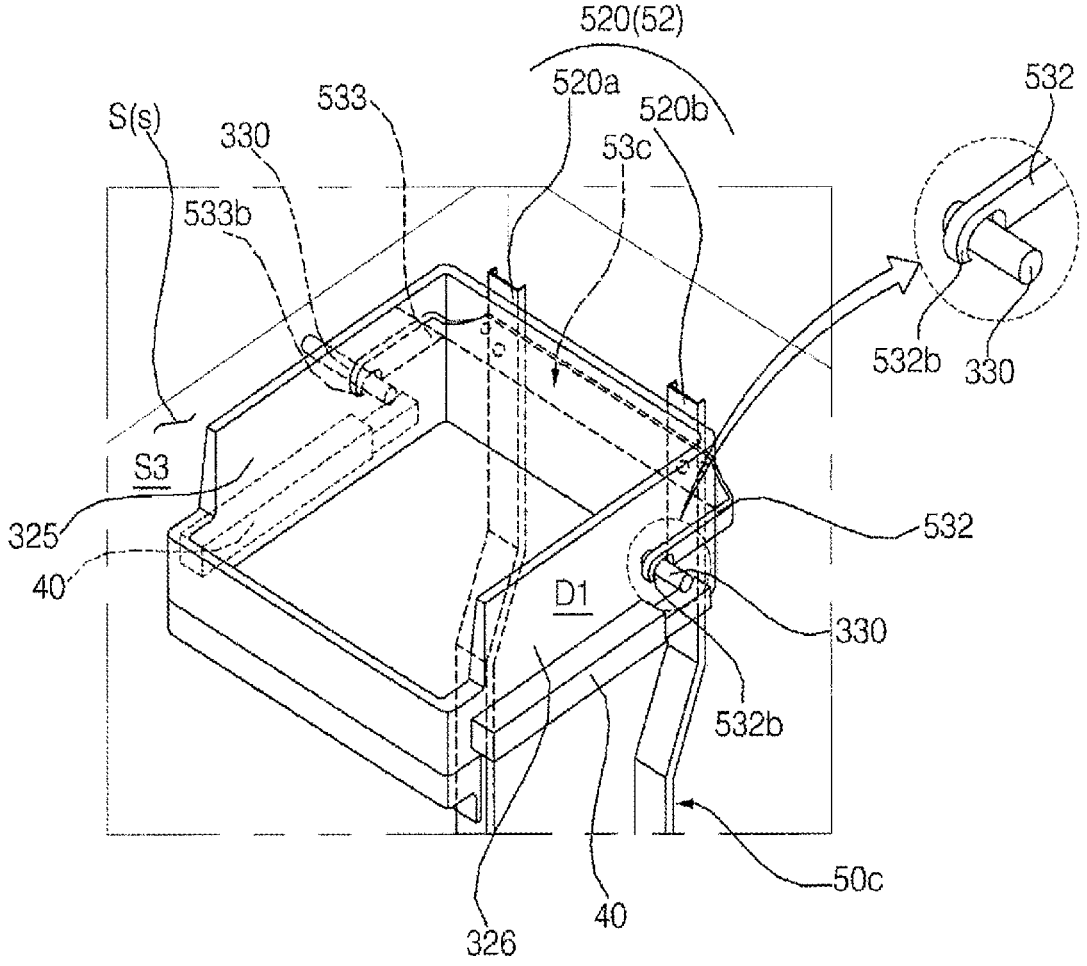

REFRIGERATOR

CROSS-REFERENCE TO RELATED APPLICATIONS

This application is a continuation of U.S. application Ser. No. 16/272,423, filed on Feb. 11, 2019, which is a continuation of U.S. application Ser. No. 15/550,518, filed on Aug. 11, 2017, now allowed, which is the National Stage application under 35 U.S.C. § 371 of International Application No. PCT/KR2016/001455, filed Feb. 12, 2016, which claims the benefit of Korean Application No. 10-2016-0001270, filed on Jan. 5, 2016, Korean Application No. 10-2016-0001267, filed Jan. 5, 2016, and Korean Application No. 10-2015-0022197, filed Feb. 13, 2015. The disclosures of the prior applications are incorporated by reference in their entirety.

TECHNICAL FIELD

The present invention relates to a refrigerator.

BACKGROUND ART

A refrigerator is an electric home appliance that is used to store food in a refrigerated state or in a frozen state.

In recent years, the capacity of the refrigerator has been greatly increased, and a home bar, an ice maker, a shelf, or a door box has been mounted on the rear of a door of the refrigerator. In this type of refrigerator, when the door of the refrigerator is closed, the component mounted on the rear of the door of the refrigerator may interfere with a shelf or a drawer mounted in a storage compartment of a main body of the refrigerator.

In order to prevent such interference, the front end of a drawer (e.g. a shelf or a drawer) mounted in the storage compartment of the main body of the refrigerator (e.g. a refrigerating compartment or a freezing compartment) is located at a place spaced apart from the front of the main body of the refrigerator by a predetermined distance.

For this reason, a user must put his/her hand into the storage compartment deeply in order to take out food stored in the drawer. Furthermore, it is difficult for the user to check the food stored in the rear portion of the storage compartment. These problems become more critical as the size of the refrigerator is increased.

Various methods have been proposed to solve the above problems. For example, Korean Patent Application Publication No. 2010-0130357 (hereinafter, referred to as '357 patent) discloses a refrigerator configured to have a structure in which a shelf or a drawer mounted in a refrigerating compartment or a freezing compartment is disposed at a receiving frame, the front end of an articulated link is connected to the bottom surface of a refrigerator door, and the rear end of the articulated link is connected to the receiving frame. When the refrigerator door is turned and opened, therefore, the receiving frame is moved forward, with the result that the shelf or the drawer is moved forward.

In the refrigerator having the above structure, the load of the shelf and the load of the drawer are transferred to the receiving frame. In other words, the load of the shelf, the load of the drawer, and the load of food stored in the shelf and the drawer are concentrated on the receiving frame. For this reason, it is important to design the receiving frame such that the receiving frame can sufficiently support the loads. In this case, however, the structure of the receiving frame is complicated and the volume of the receiving frame is increased, whereby the weight of the receiving frame is also increased. Furthermore, the capacity of the storage compartment is reduced due to the space occupied by the receiving frame.

In order to solve the above problem, it is necessary to separately provide a support means for supporting the shelf or the drawer and a withdrawal means for moving the shelf or the drawer. However, reaction force due to the action and reaction between the withdrawal means and the shelf (or the drawer) is applied to the withdrawal means and the shelf (or the drawer) when the shelf or the drawer is withdrawn by the withdrawal means even in the case in which the load of the shelf or the drawer is not applied to the withdrawal means by the provision of the support means. In particular, reaction force due to the inertia of the shelf or the drawer is applied to the withdrawal means, with the result that the withdrawal means may become deformed.

In addition, in the case in which the support means and the withdrawal means are separately provided, the withdrawal means may be moved more smoothly than the receiving frame disclosed in '357 patent. However, the withdrawal means may easily shake due to the relatively low inertia thereof.

DISCLOSURE

Technical Problem

An object of the present invention is to provide a refrigerator configured such that a withdrawal mechanism interlocked with a door for automatically withdrawing a drawer (i.e. moving the drawer forward) is provided and such that drawer guides serve to support the load of the drawer while the withdrawal mechanism serves to move the drawer, which is supported by the drawer guides, without the load of the drawer being applied to the withdrawal mechanism. In particular, another object of the present invention is to provide a refrigerator configured such that, even in the case in which a plurality of drawers is disposed in a storage compartment, the load of each drawer is individually supported by drawer guides provided for each drawer and such that the withdrawal mechanism is configured to simultaneously withdraw the drawers but not to support the load of each drawer, i.e. is configured as a non-load bearing element, and such that the withdrawal mechanism is not easily deformed by reaction force from each drawer.

Another object of the present invention is to provide a refrigerator configured such that the door is automatically returned to the original position thereof by the withdrawal mechanism when the door is closed.

A further object of the present invention is to provide a refrigerator configured such that the withdrawal mechanism is securely supported without shaking during the movement thereof.

Technical Solution

A refrigerator according to the present invention includes a withdrawal mechanism that is moved forward when a door is opened to withdraw a drawer disposed in a storage compartment forward. The withdrawal mechanism may include a base part interlocked with the door and a rear frame extending upward from the base part such that at least a portion of the rear frame is disposed at the rear of the drawer. The base part may be connected to the door via a link. Alternatively, the base part 51 may be moved by a driving means, such as an electric motor or an electric actuator, in response to the opening and closing operation of the door. The rear frame is moved simultaneously with the base part to withdraw the drawer. The drawer is moved while being supported by a drawer guide provided in the storage compartment.

Since the load of the drawer is supported by the drawer guide, the withdrawal mechanism does not serve to support the load of the drawer but serves to move the drawer. That is, a means for supporting the drawer (i.e. the drawer guide) and a means for withdrawing the drawer (i.e. the withdrawal mechanism) are separately provided. Consequently, only the load of the withdrawal mechanism is applied to the withdrawal mechanism.

In this structure, the load applied to the withdrawal mechanism is slight. Consequently, it is possible to simplify the structure of the withdrawal mechanism and to reduce the weight of the withdrawal mechanism. In particular, since the load applied to the withdrawal mechanism guide for supporting the withdrawal mechanism is also reduced, a bearing element (e.g. a rail) constituting the withdrawal mechanism guide is operated smoothly.

In particular, the withdrawal mechanism includes an arm extending forward from the rear frame so as to be disposed between the drawer and a side surface of the storage compartment, and an arm guide is disposed between the side surface of the storage compartment and the drawer for guiding the arm so as to be movable in the forward-rearward direction. Consequently, the rear frame is prevented from being deformed by reaction force applied from the drawer, and the withdrawal mechanism is stably moved without shaking.

In accordance with an aspect of the present invention, a refrigerator according to an embodiment of the present invention may include a cabinet having a storage compartment therein, the storage compartment being provided in the front surface thereof with an opening, a door hinged to the cabinet for opening and closing at least a portion of the opening, a drawer disposed in the storage compartment for storing goods, a drawer guide for supporting the drawer and guiding the drawer so as to be movable in the forward-rearward direction, a withdrawal mechanism including a base part disposed at the lower side of the drawer, the base part being configured to be moved forward when the door is opened and to be moved rearward when the door is closed, a rear frame extending from the base part toward the rear of the drawer for pushing the drawer forward when the base part is moved forward, and an arm extending forward from the rear frame so as to be disposed between the drawer and a side surface of the storage compartment, and an arm guide disposed between the side surface of the storage compartment and the drawer for guiding the arm so as to be movable in the forward-rearward direction.

In accordance with another aspect of the present invention, a catching protrusion may protrude from the drawer toward the side surface of the storage compartment, and the arm of the withdrawal mechanism may be connected to the catching protrusion. In the structure in which the arm is connected to the catching protrusion, the withdrawal mechanism may pull the drawer rearward when the door is closed. Consequently, the drawer may automatically return to the original position thereof without any additional manipulation.

The withdrawal mechanism may include a roller rotatably provided at the arm so as to be guided along the arm guide. The arm guide may include a roller guide surface configured to contact the roller at the lower side of roller, the roller guide surface extending in the direction in which the roller is moved. The arm guide may have a guide groove, which has a section that is open toward the drawer, and the roller may be supported by the roller guide surface in the guide groove.

The drawer may include a plurality of drawers arranged in the upward-downward direction, the rear frame may extend up to a height corresponding to the uppermost one of the drawers, and the arm may be disposed between the uppermost drawer and the side surface of the storage compartment.

The arm may include at least a pair of arms, the arms may be disposed between the drawer and opposite side surfaces of the storage compartment, and the arm guide may include at least a pair of arm guides for guiding the arms.

The refrigerator may further include a link, having a front end turnably connected to the door and a rear end turnably connected to the base part, for moving the base part in response to the opening and closing operation of the door.

A refrigerator according to an embodiment of the present invention may include a cabinet having a storage compartment therein, the storage compartment being provided in the front surface thereof with an opening, a door hinged to the cabinet for opening and closing at least a portion of the opening, a drawer disposed in the storage compartment for storing goods, a catching protrusion protruding from the drawer toward a side surface of the storage compartment, a drawer guide for supporting the drawer and guiding the drawer so as to be movable in the forward-rearward direction, and a withdrawal mechanism for withdrawing the drawer forward when the door is opened and returning the drawer to the original position thereof when the door is closed, wherein the withdrawal mechanism may include a base part disposed at the lower side of the drawer, the base part being configured to be moved forward when the door is opened and to be moved rearward when the door is closed, a rear frame extending from the base part toward the rear of the drawer for pushing the drawer forward when the base part is moved forward, and an arm extending forward from the rear frame so as to be disposed between the drawer and the side surface of the storage compartment, the arm being caught by the catching protrusion.

The arm may be provided with a protrusion connection hole, into which the catching protrusion is inserted. The protrusion connection hole may extend in the forward-rearward direction such that the arm is displaceable relative to the catching protrusion within a predetermined distance. The catching protrusion may be spaced apart from the rear end of the protrusion connection hole in the state in which the door is closed. The arm may include a hook configured to be coupled to the catching protrusion.

The drawer may include a plurality of drawers arranged in the upward-downward direction, the catching protrusion may protrude from the uppermost one of the drawers, the rear frame may extend up to a height corresponding to the uppermost drawer, and the arm may be disposed between the uppermost drawer and the side surface of the storage compartment.

The catching protrusion may protrude from each side surface of the drawer, and the arm may include at least a pair of arms connected to the catching protrusions.

The refrigerator may further include a link, having a front end turnably connected to the door and a rear end turnably connected to the base part, for moving the base part in response to the opening and closing operation of the door.

Advantageous Effects

A refrigerator according to an embodiment of the present invention with the above-stated construction has the following effects.

First, a withdrawal mechanism for withdrawing a drawer includes a rear frame and an arm extending forward from the rear frame, and the arm is guided while being supported by an arm guide. Consequently, it is possible to prevent the rear frame from being deformed (particularly, drooping rearward) even in the case in which reaction force is applied from the drawer to the rear frame when the withdrawal mechanism is moved forward, since the rear frame is supported by the arm.

Second, the arm is securely supported by the arm guide, whereby it is possible to reduce shaking of the withdrawal mechanism during the movement of the withdrawal mechanism.

Third, the drawer is automatically returned to the original position thereof by the withdrawal mechanism when the door is closed, thereby improving convenience in use.

DESCRIPTION OF DRAWINGS

FIG. 1 is a perspective view showing a refrigerator according to an embodiment of the present invention;

FIG. 2 is a view showing the state in which doors of the refrigerator of FIG. 1 are open;

FIG. 3 is a side view showing the interior of a storage compartment of the refrigerator according to the embodiment of the present invention;

FIG. 4 is an exploded perspective view showing main parts constituting the refrigerator of FIG. 3;

FIG. 5 is an enlarged view showing part A of FIG. 4;

FIG. 6 is a view showing an assembly of drawers and drawer guides when viewed from the front;

FIG. 7 is an enlarged view showing part B of FIG. 6;

FIG. 8 is a view showing an assembly of a withdrawal mechanism and a link when viewed from below;

FIG. 9*a* is a view of the withdrawal mechanism when viewed from the rear and from below;

FIG. 9*b* is a front view of the withdrawal mechanism;

FIG. 9*c* is a right side view of the withdrawal mechanism;

FIG. 10*a* is a view showing the bottom surface of a base part exposed in the state in which a door is closed;

FIG. 10*b* is a view showing the state in which the door of FIG. 10*a* is open to a withdrawal start angle;

FIG. 10*c* is a view showing the state in which the door of FIG. 10*b* is fully open;

FIG. 11 is a view partially showing a refrigerator according to another embodiment of the present invention; and FIG. 12 is a view partially showing a refrigerator according to a further embodiment of the present invention.

BEST MODE

The advantages and features of the present invention and methods for achieving them will be more clearly understood from the following detailed description taken in conjunction with the accompanying drawings. However, the present invention may be embodied in many different forms and should not be construed as limited to the embodiments set forth herein. Rather, these embodiments are provided so that the present invention will be thorough and complete, and will fully convey the scope of the invention to those skilled in the art. The present invention is defined only by the categories of the claims. Wherever possible, the same reference symbols will be used throughout the drawings to refer to the same or like parts.

FIG. 1 is a perspective view showing a refrigerator 1*a* according to an embodiment of the present invention. FIG. 2 is a view showing the state in which doors 3*a*, 3*b*, 3*c*, and 3*d* of the refrigerator 1*a* of FIG. 1 are open. FIG. 3 is a side view showing the interior of a storage compartment S3 of the refrigerator 1*a* according to the embodiment of the present invention. The "forward"/"rearward"/"leftward"/"rightward"/"upward"/"downward" directions set forth herein are defined as shown in FIG. 1. However, these directions are used merely to clearly describe the present invention. Consequently, the above directions may be differently defined as needed.

Referring to FIGS. 1 and 2, a refrigerator 1*a* may include a cabinet 10 having compartments RC and FC (or storage compartments S1, S2, S3, and S4) defined therein and doors 3*a*, 3*b*, 3*c*, and 3*d* for opening and closing the compartments RC and FC. The doors 3*a*, 3*b*, 3*c*, and 3*d* may be hinged to the cabinet 10.

The front surfaces of the compartments RC and FC are open such that food is introduced and removed through the front surfaces of the compartments RC and FC. The open front surfaces of the compartments RC and FC may be opened and closed by the doors 3*a*, 3*b*, 3*c*, and 3*d*. Cool air is supplied into the compartments RC and FC. The compartments RC and FC may be sealed by the doors 3*a*, 3*b*, 3*c*, and 3*d* such that cool air does not leak from the compartments RC and FC.

Two or more compartments RC and FC may be provided. For a bottom freezer type refrigerator as in this embodiment, the cabinet 10 is partitioned into the upper part and the lower part, and the compartments RC and FC are provided in the upper part and the lower part of the cabinet 10, respectively. In this case, the lower compartment FC is a freezing compartment, the interior temperature of which is maintained below 0° C., and the upper compartment RC is a refrigerating compartment, the interior temperature of which is maintained above 0° C. In the following description, a "compartment" may be a refrigerating compartment or a freezing compartment, unless mentioned otherwise.

Each of the partitions RC and FC may be opened and closed by a pair of doors. For example, as in this embodiment, the refrigerating compartment RC may be opened and closed by a pair of refrigerating compartment doors 3*a* and 3*b*, and the freezing compartment FC may be opened and closed by a pair of freezing compartment doors 3*c* and 3*d*.

The storage compartments S1, S2, S3, and S4 constitute all or portions of the partitions RC and FC. The storage compartments S1, S2, S3, and S4 may be defined as regions that are opened and closed by the doors 3*a*, 3*b*, 3*c*, and 3*d*. The refrigerating compartment RC may include a storage compartment S1, the open front surface of which is opened and closed by a left refrigerating compartment door 3*a*, and a storage compartment S2, the open front surface of which is opened and closed by a right refrigerating compartment door 3*b*. Hereinafter, the storage compartment S1 may be referred to as a left refrigerating storage compartment and the storage compartment S2 may be referred to as a right refrigerating storage compartment as needed.

In the same manner, the freezing compartment FC may include a storage compartment S3, the open front surface of which is opened and closed by a left freezing compartment door 3*c*, and a storage compartment S4, the open front surface of which is opened and closed by a right freezing compartment door 3*d*. Hereinafter, the storage compartment S3 may be referred to as a left freezing storage compartment and the storage compartment S4 may be referred to as a right freezing storage compartment as needed.

In the case in which two storage compartments are provided in one compartment in the horizontal direction, as described above, the storage compartments may communicate with each other. For example, when the refrigerating compartment RC is viewed from the front, the left refrigerating storage compartment S1 and the right refrigerating storage compartment S2 are not divided from each other. Consequently, cool air may freely flow between the left refrigerating storage compartment S1 and the right refrigerating storage compartment S2.

In this embodiment, a vertical partition 20 is provided between the left freezing storage compartment S3 and the right freezing storage compartment S4 of the freezing compartment FC, unlike the refrigerating compartment RC. As a result, the storage compartments S3 and S4 are partitioned from each other. Even in this case, however, the flow of cool air between the storage compartments S3 and S4 may not be completely blocked. For example, the vertical partition 20 may be provided with through holes (not shown), through which the storage compartments S3 and S4 communicate with each other.

Referring to FIG. 3, each of the storage compartments S1, S2, S3, and S4 may be defined by a front surface S(f) having an opening therein, a pair of side surfaces S(s) extending rearward from the front surface S(f) while facing each other, an upper surface S(u) interconnecting the upper ends of the side surfaces S(s), a bottom surface S(b) or a bottom interconnecting the lower ends of the side surfaces S(s) while facing the upper surface S(u), and a rear surface S(r) interconnecting the side surfaces S(s), the upper surface S(u), and the bottom surface S(b) while facing the opening.

According to the above definition, in the case in which one space is partitioned into two parts by the vertical partition 20 to form two storage compartments S3 and S4 in the horizontal direction, as in the freezing compartment FC, the bottom surface S(b) and the rear surface S® of each of the storage compartments S3 and S4 may be defined by the inner surface of the cabinet 10. The upper surface S(u) of each of the storage compartments S3 and S4 may be defined by the bottom surface of the horizontal partition 7, which partitions the refrigerating compartment RC and the freezing compartment FC from each other. One of the side surfaces of each of the storage compartments S3 and S4 may be defined by an inner surface 11 of the cabinet 10. The other side surface of each of the storage compartments S3 and S4 may be defined by one surface of the vertical partition 20 that faces the inner surface 11 of the cabinet 10.

Of course, in other embodiments, in the case in which the refrigerating compartment RC is partitioned into a pair of storage compartments by the vertical partition, one side surface, the upper surface, and the rear surface of each of the storage compartments S1 and S2 constituting the refrigerating compartment RC may be defined by the inner surface of the cabinet 10, the bottom surface of each of the storage compartments S1 and S2 may be defined by the upper surface of the horizontal partition 7, and the other side surface of each of the storage compartments S1 and S2 may be defined by one surface of the vertical partition that faces the one side surface.

The doors 3*a*, 3*b*, 3*c*, and 3*d* may be provided so as to correspond to the storage compartments S1, S2, S3, and S4. A door storage unit for storing food may be formed in the rear parts of the doors 3*a*, 3*b*, 3*c*, and 3*d*, i.e. the parts of the doors 3*a*, 3*b*, 3*c*, and 3*d* that face the open front surfaces of the storage compartments S1, S2, S3, and S4. The door storage unit may include storage chambers 8*a* for storing food that is frequently taken out of the refrigerator, such as dairy products, beverages, vegetables, etc, a tray 8*b* for storing ice, and baskets 8*c* for storing small-sized frozen food. In the state in which the doors 3*a*, 3*b*, 3*c*, and 3*d* are closed, at least a portion of the door storage unit 8*a*, 8*b*, and 8*c* may be located in the storage compartments S1, S2, S3, and S4.

A drawer D may be disposed in the compartments RC and FC or the storage compartments S1, S2, S3, and S4. The drawer D is provided to store or hold food. A plurality of drawers may be arranged in the upward-downward direction. Each drawer D may be constituted by a container (or a bin) 320 having a predetermined-sized space for storing food. Alternatively, each drawer D may be constituted by a horizontal plate-shaped shelf 310.

FIG. 4 is an exploded perspective view showing main parts constituting the refrigerator 1*a* of FIG. 3. FIG. 5 is an enlarged view showing part A of FIG. 4. FIG. 6 is a view showing an assembly of drawers D1, D2, and D3 and drawer guides 40 when viewed from the front. FIG. 7 is an enlarged view showing part B of FIG. 6. FIG. 8 is a view showing an assembly of a withdrawal mechanism 50*a* and a link 70 when viewed from below. FIG. 9*a* is a view of the withdrawal mechanism 50*a* when viewed from the rear and from below. FIG. 9*b* is a front view of the withdrawal mechanism 50*a*. FIG. 9*c* is a right side view of the withdrawal mechanism 50*a*.

Hereinafter, the left freezing storage compartment S3 will be described by way of example with reference to the drawings. The structure of the left freezing storage compartment S3, which will be described below, may be applied to the other storage compartments S1, S2, and S4. In addition, the structure of the left freezing storage compartment S3 may also be applied to compartments of other embodiments, a description of which will follow.

The refrigerator 1*a* may include a cabinet 10, a door 3*c*, drawers D1, D2, and D3, drawer guides 40, a withdrawal mechanism 50*a*, a withdrawal mechanism guide 60, and a link 70.

Referring to FIG. 4, the drawer guides 40 may be disposed in the storage compartment S3 to support the drawers D. The drawer guides 40 guide the drawers D such that the drawers D can be moved in the forward-rearward direction. A pair of drawer guides 40 may be provided at opposite sides of one drawer (e.g. the drawer D1) to support the load of the drawer D1. In this embodiment, three drawer guides 40 are disposed at one side surface S(s) of the storage compartment S3 so as to correspond to three drawers D1, D2, and D3. Although not shown in FIG. 4, three drawer guides 40 are also disposed at the other side surface S(s) of the storage compartment S3.

A pair of drawer guides 40, provided for each drawer D, may include a first drawer guide 40(L) disposed at the inner surface 11 of the cabinet 10, which defines one side surface S(s) of the storage compartment S3, and a second drawer guide 40(R) disposed at the other side surface S(s) (e.g. one surface of the vertical partition 20) of the storage compartment S3 (see FIG. 6).

The drawers D are supported by the drawer guides 40 in a state of static mechanical equilibrium. That is, the entire load of each drawer D is supported by the drawer guides 40. Each drawer D remains stationary on the drawer guides 40 unless external force is applied to the drawer D. The entire load of each drawer D is substantially supported by the drawer guides 40. A rear frame 52, a description of which will follow, is a non-load bearing element, which does not support the load of the drawers D.

Each drawer guide 40 may be formed to have various shapes, including that of a rail or a roller. For example, referring to FIGS. 6 and 7, each drawer guide 40 may include a stationary rail 41 fixed to the inner surface S(s) of the storage compartment S3 and extending in the forward-rearward direction and moving rails 42 and 43 configured to move along the stationary rail 41 such that the moving rails 42 and 43 move together with a corresponding one of the drawers D. A single moving rail may be provided, or two moving rails 42 and 43 may be provided as in this embodiment. The first moving rail 42 is coupled to a corresponding one of the drawers D in the state of being engaged with the second moving rail 43. The second moving rail 43 is engaged with the stationary rail 41.

When the drawer D1 is moved forward a predetermined distance from the original position (i.e. the position in the state in which the door 3*c* is closed), the first moving rail 42 moves along the second moving rail 43. When the first moving rail 42 moves forward further than the predetermined distance, the second moving rail 43 may move along the stationary rail 41. However, the structure of each drawer guide is not limited thereto. For example, each of the drawer guides may include a stationary rail fixed to the side surface S(s) of the storage compartment S3 and a moving rail rotatably provided at a corresponding one of the drawers D so as to roll along the stationary rail during the movement of the drawer D.

Referring to FIG. 7, the stationary rail 41 is formed by bending a metal sheet several times. The stationary rail 41 may include a first strip part 411 extending in the forward-rearward direction in the state of being parallel to the side surface S(s) of the storage compartment S3, a second strip part 412 horizontally extending from the lower end of the first strip part 411 toward the drawer D1, and a pocket part 413 formed at one end of the second strip part 412 such that the lower end 431 of the second moving rail 43 is inserted into the pocket part 413.

The pocket part 413 has a "U"-shaped pocket having an inlet formed in the upper side thereof. The lower end 431 of the second moving rail 43 may be inserted into the pocket through the inlet in the pocket. The first moving rail 42 may have a section corresponding to the section of the pocket part 413. The first moving rail 42 has an inverse "U"-shaped pocket having an inlet formed in the lower side thereof. The upper end 432 of the second moving rail 43 may be inserted into the pocket through the inlet in the pocket.

A hook 422 may protrude upward from the first moving rail 42. A drawer connection member 321 for connecting the drawer D1 to the first moving rail 42 may be provided such that the drawer D1 can be supported by the drawer guide 40. In this embodiment, the drawer connection member 321 is integrally formed with the drawer D1. However, the present invention is not limited thereto. The drawer connection member 321 may be formed as a separate part, and may then be coupled to the drawer D1.

The drawer connection member 321 may include a horizontal rib 321*a* coupled to the hook 422 of the first moving rail 42. The horizontal rib 321*a* may horizontally protrude from the outer surface of the drawer D1 in the lateral direction, and may extend in the forward-rearward direction.

The hook 422 may include a first part 422*a* protruding upward from the upper surface 421 of the first moving rail 42 and a second part 422*b* extending forward from the upper end of the first part 422*a*. The horizontal rib 321*a* may be provided with a coupling hole (not shown) having an appropriate shape. The hook 422 may extend upward through the coupling hole. In this embodiment, the drawer D1 and the first moving rail 42 move simultaneously as the result of the coupling between the horizontal rib 321*a* and the hook 422. However, the present invention is not limited thereto. The drawer D1 and the first moving rail 42 may be coupled to each other in other different manners within a range in which the drawer D1 and the first moving rail 42 move simultaneously.

The drawer D1 and the first moving rail 42 may be coupled to each other such that a user can easily separate the drawer D1 and the first moving rail 42 from each other without using a tool. That is, the drawer D1 and the first moving rail 42 may be coupled to each other based on a structure in which the drawer D1 and the first moving rail 42 may be coupled to each other such that the drawer D1 and the first moving rail 42 can be manually separated from each other by the user, rather than a structure in which the drawer D1 and the first moving rail 42 are coupled to each other using a screw or bolt such that the state of coupling between the drawer D1 and the first moving rail 42 is maintained before the drawer D1 and the first moving rail 42 are separated from each other using a tool. In this embodiment, the user may appropriately move the drawer D1 to insert the hook 422 of the first moving rail 42 into the coupling hole formed in the horizontal rib 321*a* or to separate the hook 422 from the coupling hole. After being separated from the first moving rail 42, the drawer D1 may be withdrawn out of the storage compartment S3.

Meanwhile, the drawer connection member 321 may further include a vertical rib 321*b* extending downward from one end of the horizontal rib 321*a*. The vertical rib 321*b* may abut a first side surface 423 of the first moving rail 42. In other embodiments, a screw or bolt (hereinafter, referred to as a "fastening member") for coupling the vertical rib 321*b* to the first side surface 423 may be further provided. The first side surface 423 of the first moving rail 42 is located at one of two side surfaces 423 and 424 extending downward from the opposite sides of the horizontal upper surface 421 of the first moving rail 42 that is closer to the first strip part 411.

The second strip part 412 is provided with an inverse "V"-shaped (i.e. an upward concave-shaped) notch 412*a*. A lower maintenance protrusion 143*a* of a bracket 14, a description of which will follow, may be inserted into the notch 412*a*. The notch 412*a* may be formed in the portion of the second strip part 412 that meets the pocket 413.

A bracket 14 for installing each drawer guide 40 may be disposed at the side surface S(s) of the storage compartment S3. The bracket 14 may protrude from the side surface S(s) of the storage compartment S3 toward the drawer D1. The bracket 14 may extend in the forward-rearward direction.

The bracket 14 may be provided with a rail installation groove 14*a*, which extends in the forward-rearward direction. The stationary rail 41 is installed in the rail installation groove 14*a*. The rail installation groove 14*a* may be defined by a vertical surface 141 extending in the forward-rearward direction while being approximately parallel to the side surface S(s) of the storage compartment S3 and an upper horizontal surface 142 and a lower horizontal surface 143 horizontally protruding respectively from the upper end and the lower end of the vertical surface 141 while extending in the forward-rearward direction.

An elastic support tab 144, which is formed by cutting the vertical surface 141, may be provided in the rail installation groove 14*a*. The elastic support tab 144 may be elastically turned with respect to the vertical surface 141. The elastic support tab 144 is pushed by the first strip part 411 of the stationary rail 41 in the lateral direction.

In the state in which the stationary rail 41 is installed in the rail installation groove 14*a*, the elastic support tab 144 remains pushed by the stationary rail 41, i.e. deformed. Since the elastic support tab 144 is elastically deformed, the elastic support tab 144 returns to the original state thereof when external force is removed (i.e. when the stationary rail 41 is separated).

The bracket 14 may further include an upper maintenance protrusion 142*a* protruding downward from the upper horizontal surface 142 of the rail installation groove 14*a* and/or a lower maintenance protrusion 143*a* protruding upward from the lower horizontal surface 143.

In the state in which the first strip part 411 of the stationary rail 41 is inserted into the rail installation groove 14*a*, the upper end of the first strip part 411 is located between the vertical surface 141 and the upper maintenance protrusion 142*a*. In particular, the gap between the vertical surface 141 and the upper maintenance protrusion 142*a* is formed so as to correspond to the thickness of the first strip part 411. Consequently, the lateral movement of the upper end of the first strip part 411 is limited by the upper maintenance protrusion 142*a*, whereby the upper end of the first strip part 411 is prevented from escaping from the gap.

The second strip part 412 may be located on the lower horizontal surface 143. The lower horizontal surface 143 may have a larger width than the upper horizontal surface 142. The lower maintenance protrusion 143*a* may be formed at a position closer to the drawer D1 than the upper maintenance protrusion 142*a* by a distance corresponding to the difference in width between the lower horizontal surface 143 and the upper horizontal surface 142.

The lower maintenance protrusion 143*a* may be inserted into the notch 412*a* of the stationary rail 41. The lateral movement of the lower maintenance protrusion 143*a* is limited by the notch 412*a*. The lower end of the stationary rail 41 may be securely coupled to the bracket 14 by fastening force between the lower maintenance protrusion 143*a* and the notch 412*a*.

In the state in which the stationary rail 41 is installed at the bracket 14, the first strip part 411 is pushed by the elastic support tab 144 in the lateral direction (i.e. toward the drawer D1). As a result, the upper end of the first strip part 411 is in tight contact with the upper maintenance protrusion 142*a*. In this state, the lower maintenance protrusion 143*a* is inserted into the notch 412*a*. Consequently, the stationary rail 41 is securely supported without shaking.

In the above description, the rail installation groove 14*a* is formed in the bracket 14, and the bracket 14 is coupled to the side surface S(s) of the storage compartment S3, by way of example. However, the present invention is not limited thereto. The bracket 14 may be formed integrally with the inner surface 11 of the cabinet, which defines the side surface S(s) of the storage compartment S3, or the vertical partition 20.

Referring to FIG. 3, the withdrawal mechanism 50*a* may move in response to the opening and closing operation of the door 3*c*. The withdrawal mechanism 50*a* may move forward when the door 3*c* is opened. The withdrawal mechanism 50*a* may move rearward when the door 3*c* is closed. The drawers D1, D2, and D3 are moved in response to the operation of the withdrawal mechanism 50*a*. In particular, the withdrawal mechanism 50*a* may move the drawers D1, D2, and D3 forward when the door 3*c* is opened. In FIG. 3, the positions of the withdrawal mechanism 50*a* and the drawers D1, D2, and D3 in the state in which the door 3*c* is closed are indicated by dotted lines. When the door 3*c* is opened in this state, the withdrawal mechanism 50*a* pushes the drawers D1, D2, and D3 forward while moving forward. The positions of the withdrawal mechanism 50*a* and the drawers D1, D2, and D3 at this time are indicated by solid lines.

Since the drawers D1, D2, and D3 are located forward by a predetermine distance from the positions at which the drawers D1, D2, and D3 are initially received (i.e. the positions of the drawers D1, D2, and D3 in the state in which the door 3*c* is closed; hereinafter, referred to as "original positions") in the state in which the opening of the front surface S(f) of the storage compartment S3 is open as the result of opening of the door 3*c*, the user easily accesses the drawers D1, D2, and D3, with the result that the user can easily take food out of the drawers D1, D2, and D3 or put food in the drawers D1, D2, and D3. Such convenience is particularly critical for a large-capacity refrigerator having a deep storage compartment S3.

Referring to FIGS. 4, 8, and 9*a* to 9*c*, the withdrawal mechanism 50*a* may include a base part 51 disposed at the lower side of the drawer D3 and a rear frame 52 extending upward from the base part 51. At least a portion of the rear frame 52 is disposed at the rear of the drawers D1, D2, and D3. The rear frame 52 may extend toward the upper surface S(u) of the storage compartment S3 through the space between the drawers D1, D2, and D3 and the rear surface S(r) of the storage compartment S. The rear frame 52 may extend up to at least a height corresponding to the drawer D1. In the following description, all of the drawers D1, D2, and D3, which are disposed in the storage compartment S3, are pushed by the rear frame 52 when the door 3*c* is opened, by way of example. In other embodiments, the lowermost one of the drawers D1, D2, and D3, i.e. the drawer D3, may be supported by the base part 51. In this case, the drawer guide 40*a* for supporting the drawer D3 may be omitted.

The refrigerator 1*a* may include a withdrawal mechanism guide 60 for guiding the withdrawal mechanism 50*a* such that the withdrawal mechanism 50*a* is movable in the forward-rearward direction. The withdrawal mechanism guide 60 may be disposed between each side surface S(s) of the storage compartment S3 and the base part 51, or may be disposed at each side of the base part 51. The withdrawal mechanism guide 60 may include rails 61 disposed at one of the side surfaces S(s) of the storage compartment S3 and the base part 51 and rollers 62 disposed at the other of the side surfaces S(s) of the storage compartment S3 and the base part 51 so as to rotate as the result of contact with the rails 61 during the movement of the base part 51. In this embodiment, the withdrawal mechanism 50*a* may include rails 61 fixed to the side surfaces S(s) of the storage compartment S3 and extending in the forward-rearward direction and rollers 62 rotatably mounted to the side surfaces 512 and 513 of the base part 51 (see FIG. 9*b*) so as to roll along the rails 61 during the movement of the withdrawal mechanism 50*a*. However, the present invention is not limited thereto. In place of the rollers 62, moving rails (not shown) engaged with the rails 61 may be provided at the base part 51.

In addition, the rollers 62 may be fixed to the side surfaces S(s) of the storage compartment S3, and the rails 61 may be disposed at the side surfaces 512 and 513 of the base part 51 such that the rails 61 move while being supported by the rollers 62.

Furthermore, the withdrawal mechanism guide 60 may be disposed between the bottom surface S(b) of the storage compartment S3 and a bottom surface 511 of the base part 51 (see FIG. 9*b*). For example, a stationary rail may be disposed at the bottom surface S(b) of the storage compartment S3, and a moving rail, which is engaged with the stationary rail so as to move along the stationary rail when the base part 51 is moved, may be disposed at the bottom surface 511 of the base part 51.

Referring to FIG. 9*b*, the base part 51 includes a horizontal bottom surface 511. The upper side of the bottom surface 511 faces upward, and the bottom side of the bottom surface 511, which is opposite the upper side, faces the bottom surface S(b) of the storage compartment S. In the case in which a plurality of drawers D1, D2, and D3 is arranged in the upward-downward direction, as in this embodiment, the base part 51 may be disposed lower than the lowermost drawer D3.

The link 70 connects the door 3*c* and the base part 51. One end of the link 70 may be turnably connected to the door 3*c*, and the other end of the link 70 may be turnably connected to the base part 51. The link 70 will be described in more detail later.

Referring to FIGS. 9*a* to 9*c*, the base part 51 may have a structure in which the front surface and the upper surface of the base part 51 are open. Specifically, the base part 51 may include a horizontal bottom surface 511, a pair of side surfaces 512 and 513 extending upward from opposite ends of the bottom surface 511, and a rear surface 514 extending upward from the rear end of the bottom surface 511 for interconnecting the side surfaces 512 and 513.

The rear frame 52 may include a pair of vertical bars 520*a* and 520*b* extending upward from the base part 51 while being spaced apart from each other in the width direction of the storage compartment S3. Each of the vertical bars 520*a* and 520*b* may extend upward from the rear surface 514. Hereinafter, the vertical bars 520*a* and 520*b* will be referred to as a first vertical bar 520*a* and a second vertical bar 520*b* when it is necessary to distinguish the vertical bars 520*a* and 520*b* from each other.

The first vertical bar 520*a* and the second vertical bar 520*b* may not be formed as separate members. The first vertical bar 520*a* and the second vertical bar 520*b* may be formed as a single body using a single frame member 520 formed in a bend or beam shape having a length larger than a width w (see FIG. 9*a*). That is, the frame member 520 may include sections 521 to 524 forming the first vertical bar 520*a*, sections forming the second vertical bar 520*b*, and a connection section 520*c* for connecting the first vertical bar 520*a* and the second vertical bar 520*b*. The first vertical bar 520*a* and the second vertical bar 520*b* are formed in substantially the same shape, and are parallel to each other.

Since the first vertical bar 520*a* and the second vertical bar 520*b* are spaced apart from each other, cool air may pass through therebetween. Consequently, the cool air may be supplied deeply to the inside of the storage compartment S3. Particularly, in the case in which a discharge port, through which cool air is discharged, is formed in the rear surface S(r) of the storage compartment S3, the cool air discharged through the discharge port may be uniformly distributed in the storage compartment S3.

The connection section 520*c* may be disposed at the lower side of the base part 51 to support the base part 51. The connection section 520*c* may be coupled to the base part 51 using a fastening member. The connection section 520*c* may include a section 545*a* extending forward from the lower end of the first vertical bar 520*a*, a section 545*b* extending forward from the lower end of the second vertical bar 520*b*, and a section 546 extending in the width direction of the storage compartment S3 between the sections 545*a* and 545*b*. The section 546 is perpendicular to the section 545*a* and the section 545*b*.

The frame member 520 may be formed by injection-molding a synthetic resin. Alternatively, the frame member 520 may be formed by pressing a metal material. The front surface of the bar 520 and the outer surface of the base part 51 (e.g. the rear side of the rear surface 514 and the lower side of the bottom surface 511) may be coupled to each other using fastening members 56.

The lower ends of the vertical bars 520*a* and 520*b* may be located on the rear side of the rear surface 514 of the base part 51. The lower ends and the rear surface 514 may be coupled to each other using the fastening members 56 at two or more points spaced in the longitudinal direction of the vertical bars 520*a* and 520*b*.

The vertical bars 520*a* and 520*b* may be disposed symmetrically with a middle line M (see FIG. 9*b*) equally dividing the width of the rear surface 514, e.g. a line connecting portions located equidistant from the side surfaces 512 and 513 of the base part 51.

Referring to FIG. 9*c*, the rear surface 514 of the base part 51 may extend upward from the bottom surface 511 of the base part 51 while being inclined rearward. Each of the vertical bars 520*a* and 520*b* may include a first inclined section 521, the lower end of which is located on the rear side of the rear surface 514 of the base part 51 and which extends upward from the lower end while being inclined at an inclination corresponding to the inclination of the rear surface 514, and a first vertical section 522 vertically extending from the first inclined section 521 to at least a height corresponding to the lowermost one of the drawers D1, D2, and D3, i.e. the drawer D3 (i.e. to at least a height at which the first vertical section 522 can contact the drawer D3). During the movement of the withdrawal mechanism 50*a*, the rear surface of the drawer D3 may contact the first vertical section 521. The drawer D3 may be configured to occupy a region located further rearward than the base part 51. Correspondingly, the first inclined section 521 is inclined rearward from the base part 51, and the first vertical section 522 extends upward from the first inclined section 521. Consequently, the first vertical section 522 may contact the drawer D3 even when the rear part of the drawer D3 is located further rearward than the base part 51.

In addition, each of the vertical bars 520*a* and 520*b* may include a second inclined section 523 extending upward from the first vertical section 522 while being inclined rearward and a second vertical section 524 vertically extending from the second inclined section 523 to at least a height corresponding to the drawer D2, which is disposed above the drawer D3 (i.e. to at least a height at which the 50*a* can contact the drawer D2). In this embodiment, the second vertical section 524 extends to a height at which the second vertical section 524 can contact the drawer D1, since three drawers D1, D2, and D3 are provided. As shown in FIGS. 3 and 4, the drawers D2 and D3 are configured to occupy regions located further rearward than the drawer D2 such that the drawers D2 and D3 can contact the second vertical section 524.

The rear surface 514 of the base part 41 may extend higher than the side surfaces 512 and 513, and may contact the vertical bars 520*a* and 520*b* above the side surfaces 512 and 513. That is, the rear surface is formed so as to extend higher than the side surfaces 512 and 513. Consequently, the contact area between the rear surface and the vertical bars 520*a* and 520*b* is increased, with the result that the vertical bars 520*a* and 520*b* may be supported more stably.

In particular, the vertical bars 520*a* and 520*b* may be coupled to the rear surface 514 of the base part 51. Specifically, the first inclined section 521 of each of the vertical bars 520*a* and 520*b* is coupled to the rear surface 514 using the fastening members 56. In the structure in which the vertical bars 520*a* and 520*b* are coupled to the rear surface 514, the rear surface 514 securely holds the lower ends of the vertical bars 520*a* and 520*b*. Even though reaction force from the drawers D1, D2, and D3 (e.g. repulsive force generated by inertia of the drawers D1, D2, and D3) is applied to the vertical bars 520*a* and 520*b* when the withdrawal mechanism 50*a* pushes the drawers D1, D2, and D3 forward, therefore, the vertical bars 520*a* and 520*b* are prevented from easily drooping or being curved rearward.

In addition, the vertical bars 520*a* and 520*b* are connected to each other via the connection section 520*c*, the connection section 520*c* has a '['-shaped frame structure constituted by the sections 545*a*, 545*b*, and 546, and the connection section 520*c* is in tight contact with or coupled to the bottom side of the bottom surface 511 of the base part 51. Consequently, the connection section 520*c* prevents the vertical bars 520*a* and 520*b* from drooping rearward due to repulsive forces from the drawers D1, D2, and D3.

In addition, the first vertical bar 520*a* and the second vertical bar 520*b* are not separated from each other but are integrally connected to each other via the connection section 520*c*. Even when forces of different magnitudes are applied to the vertical bars 520*a* and 520*b*, therefore, the forces are distributed by the connection section 520*c*, with the result that the forces are uniformly applied to the vertical bars 520*a* and 520*b*. Consequently, twisting of the rear frame 52 is prevented.

Meanwhile, the withdrawal mechanism 50*a* may further include a connection bar 53 for interconnecting the first vertical bar 520*a* and the second vertical bar 520*b* above the base part 51. The connection bar 53 may structurally stabilize the first vertical bar 520*a* and the second vertical bar 520*b*. In particular, the connection bar 53 may prevent the increase in distance between the first vertical bar 520*a* and the second vertical bar 520*b*. In addition, in this structure, one of the vertical bars (e.g. the vertical bar 520*a*) is prevented from drooping rearward further than the other vertical bar (e.g. the vertical bar 520*b*) even in the case in which the magnitudes of forces applied from the drawers D1, D2, and D3 to the vertical bars 520*a* and 520*b* are different from each other when the withdrawal mechanism 50*a* pushes the drawers D1, D2, and D3.

The connection bar 53 may interconnect the upper parts of the first vertical bar 520*a* and the second vertical bar 520*b*. The connection bar 53 may be coupled to the second vertical sections 524 of the vertical bars 520*a* and 520*b*. Specifically, the connection bar 53 is coupled to the upper ends of the second vertical sections 524, rather than to the lower ends of the second vertical sections 524 (i.e. the ends of the second vertical sections 524 that are connected to the second inclined sections 523).

Referring to FIGS. 9*a* to 9*c*, the withdrawal mechanism 50*a* may include arms 532 and 533 extending forward from the rear frame 52 so as to be located between the drawers D1, D2, and D3 and the side surfaces S(s) of the storage compartment S3 and to be guided along arm guides 91. A pair of arms 532 and 533 are provided at opposite sides of the drawers D1, D2, and D3 so as to be guided by the arm guides 91, which are disposed at the side surfaces S(s) of the storage compartment S3.

In the case in which the rear frame 52 includes the vertical bars 520*a* and 520*b*, the arms 532 and 533 may extend forward with respect to the vertical bars 520*a* and 520*b*. In this embodiment, the arms 532 and 533 are formed at the connection bar 53, which is coupled to the rear frame 52. However, the present invention is not limited thereto. The arms 532 and 533 may extend from the vertical bars 520*a* and 520*b*.

Meanwhile, the connection bar 53 may include a connection part 531 extending in the width direction of the storage compartment S3 for interconnecting the vertical bars 520*a* and 520*b*. The connection part 531 is coupled to the vertical bars 520*a* and 520*b*. Opposite ends of the connection part 531 may protrude from the vertical bars 520*a* and 520*b* toward the side surfaces S(s) of the storage compartment S3. The arms 532 and 533 may extend forward from the opposite ends of the connection part 531. The arms 532 and 533 may be disposed between the drawer D1 and the side surfaces S(s) of the storage compartment S3. Each of the arms 532 and 533 may be provided with a roller 92. The rollers 92 may roll along the arm guides 91 during the movement of the withdrawal mechanism 50*a*.

The connection part 531 may be provided with elastic protrusions 536. The elastic protrusions 536 may be made of a material exhibiting predetermined elastic force (e.g. rubber). The elastic protrusions 536 may be disposed at the front surface of the connection part 531, which contacts the drawer D1, so as to contact the drawer D1 when the withdrawal mechanism 50*a* is moved forward. When the withdrawal mechanism 50*a* is moved forward as the door 3*c* is opened, the elastic protrusions 536 contact the drawer D1, thereby eliminating impacts and reducing noise resulting from the impacts.

Referring to FIGS. 4 and 5, the arm guides 91 may be disposed at the side surfaces S(s) of the storage compartment S3. Specifically, the arm guides 91 may be located higher than the drawer guide 40 for supporting the uppermost drawer D1.

The arm guides 91 may include roller guide surfaces 91*b* extending in the direction in which the rollers 91 are moved, i.e. in the forward-rearward direction of the storage compartment S3, so as to contact the rollers 91 at the lower sides of the rollers 91. The roller guide surfaces 91*b* may be level.

As shown in FIG. 5, each arm guide 91 may have a guide groove 91*a*, which has a '['-shaped section that is open toward the drawer D. The roller 92 may be supported by the roller guide surface 91*b* in the guide groove 91*a*. The guide groove 91*a* may further include an upper surface 91*c* provided above the roller guide surface 91*b* so as to be parallel to the roller guide surface 91*b*. The distance between the roller guide surface 91*b* and the upper surface 91*c* is slightly greater than the diameter of the roller 92 such that the roller 92 does not contact the upper surface 91*c* when the roller 92 rolls along the roller guide surface 91*b*.

The reaction force applied from the drawers D1, D2, and D3 to the rear frame 52 during the movement of the withdrawal mechanism 50*a* may cause the vertical bars 520*a* and 520*b* to pivot rearward about the connections thereof with the base part 51 (i.e. may cause the vertical bars 520*a* and 520*b* to droop rearward). However, the downward displacement of the roller 92 due to the tendency of the vertical bars 520*a* and 520*b* to droop is prevented by the roller guide surface 91*b*. As a result, the vertical bars 520*a* and 520*b* are prevented from drooping rearward.

In addition, since the rollers 92, which are provided at the arms 532 and 533, are moved while being supported by the arm guides 91, the withdrawal mechanism 50*a* may be stably moved without shaking.

As shown in FIG. 5, each arm guide 91 may have a guide groove 91*a*, which has a '['-shaped section that is open toward the drawer D. The roller 92 may be supported by the roller guide surface 91*b* in the guide groove 91*a*. The guide groove 91*a* may further include an upper surface 91*c* provided above the roller guide surface 91*b* so as to be parallel to the roller guide surface 91*b*. The distance between the roller guide surface 91*b* and the upper surface 91*c* is slightly greater than the diameter of the roller 92 such that the roller 92 does not contact the upper surface 91*c* when the roller 92 rolls along the roller guide surface 91*b*.

The reaction force applied from the drawers D1, D2, and D3 to the rear frame 52 during the movement of the withdrawal mechanism 50*a* may cause the vertical bars 520*a* and 520*b* to pivot rearward about the connections thereof with the base part 51 (i.e. may cause the vertical bars 520*a* and 520*b* to droop rearward). However, the downward displacement of the roller 92 due to the tendency of the vertical bars 520*a* and 520*b* to droop is prevented by the roller guide surface 91*b*. As a result, the vertical bars 520*a* and 520*b* are prevented from drooping rearward.

Meanwhile, in the refrigerator 1*a* according to this embodiment, the door 3*c* and the base part 51 are connected to each other via the link 70, which is a means for moving the withdrawal mechanism 50*a* in response to the opening and closing operation of the door 3*c*. However, the present invention is not limited thereto. In other embodiments, the base part 51 may be moved by a driving means, such as an electric motor or an electric actuator. For example, in the case in which a motor is provided as the driving means, the base part 51 may be moved by a power conversion means that converts the rotational force of the motor into a rectilinear motion. An example of the power conversion means may include a rack and pinion or a crank. The driving means may be operated in response to the opening and closing operation of the door 3*c*. That is, when the door 3*c* is opened, the driving means may be operated such that the withdrawal mechanism 50*a* is moved forward by the power conversion means. Furthermore, when the door 3*c* is closed, the driving means may be operated such that the withdrawal mechanism 50*a* is moved rearward by the power conversion means.

Meanwhile, in this embodiment, the withdrawal mechanism 50*a* is separated from the drawers D1, D2, and D3. That is, the drawers D are not coupled or fastened to the rear frame 52. When the door 3*c* is opened, therefore, the drawers D1, D2, and D3 move forward as the result of contact with the rear frame 52. However, such contact between the rear frame 52 and the drawers D1, D2, and D3 is temporarily achieved to withdraw the drawers D1, D2, and D3. Particularly, in the case in which the drawers D1, D2, and D3 are supported by the drawer guides 40 in a state of static mechanical equilibrium, the rear frame 52 merely pushes and moves the drawers D1, D2, and D3 without supporting the loads of the drawers D1, D2, and D3 even when contact between the rear frame 52 and the drawers D1, D2, and D3 is temporarily achieved. This is equally applied even in the case in which the rear frame 52 is continually coupled to the drawers D1, D2, and D3 in other embodiments.

In other words, in the structure in which the drawers D1, D2, and D3 are separated from or not coupled to the withdrawal mechanism 50*a*, the movement of the drawers D1, D2, and D3 may be achieved by separable contact between the withdrawal mechanism 50*a* and the drawers D1, D2, and D3. That is, when the withdrawal mechanism 50*a* moves forward in response to the opening operation of the door 3*c*, the rear frame 52 contacts the drawers D1, D2, and D3, with the result that the drawers D1, D2, and D3 are pushed by the rear frame 52. However, the contact between the rear frame 52 and the drawers D1, D2, and D3 may be released as needed. For example, when the user stops turning the door 3*c* and closes the door 3*c* again while the drawers D1, D2, and D3 are pushed forward by the rear frame 52, the contact between the rear frame 52 and the drawers D1, D2, and D3 may be released, at least temporarily.

However, the present invention is not limited thereto. The withdrawal mechanism 50*a* (particularly, the rear frame 52) may be continually coupled to the drawers D1, D2, and D3. Even in this case, the loads of the drawers D1, D2, and D3 are not applied to the withdrawal mechanism 50*a*, as long as the drawers D1, D2, and D3 are supported by the drawer guides 40 in a state of static mechanical equilibrium. In this case, however, the withdrawal mechanism 50*a* may move the drawers D1, D2, and D3 rearward when the door 3*c* is closed.

FIG. 10*a* is a view showing the bottom surface of the base part 51 exposed in the state in which the door 3*c* is closed. FIG. 10*b* is a view showing the state in which the door 3*c* of FIG. 10*a* is open to a withdrawal start angle θ. FIG. 10*c* is a view showing the state in which the door 3*c* of FIG. 10*b* is fully open. Referring to FIGS. 10*a* to 10*c*, a front end 71 of the link 70 may be turnably connected to the door 3*c*, and a rear end 72 of the link 70 may be turnably connected to the base part 51. That is, the front end 71 may be turnably coupled to the door 3*c* so as to constitute a first turning joint J1, and the rear end 72 may be turnably coupled to the base part 51 so as to constitute a second turning joint J2.

The first turning joint J1 is spaced apart from the center of turning of the door 3*c* with respect to the cabinet 10, i.e. a turning axis C of the door 3*c*, by a predetermined distance r. When the door 3*c* is turned, therefore, the first turning joint J1 moves along the circumference of a circle having a radius r about the turning axis C of the door 3*c*. Since the position of the first turning joint J1 is variable on the circumference of the circle, the second turning joint J2 is displaced, with the result that the base part 51 is moved. The first turning joint J1 and the second turning joint J2 may be opposite each other about a reference line L that is located equidistant from the withdrawal mechanism guides 60, which are disposed at the opposite sides of the base part 51. In this embodiment, the withdrawal mechanism guides 60 are disposed symmetrically with respect to the base part 51. Consequently, the reference line L is substantially the same as a middle line of the base part 51, i.e. a line M (see FIG. 9*b*) that is located equidistant from the side surfaces 512 and 513 of the base part 51.

Although the position of the second turning joint J2 relative to the base part 51 may be fixed, the position of the second turning joint J2 relative to the base part 51 may be variable within a predetermined portion of the entire range in which the door 3*c* is turned, as in this embodiment. For example, the base part 51 may be provided with a slit 517 extending in the forward-rearward direction, and the second turning joint J2 may move along the slit 517. To this end, the link 70 may be provided in the rear end 72 thereof with a fastening hole, into which a fastening member is fastened. The fastening member is fastened into the fastening hole through the slit 517. That is, the second turning joint J2 is a movable turning joint that is capable of moving along the slit 517 and turning with respect to the base part 51 in response to the turning operation of the door 3*c*. The slit 517 may have a predetermined distance such that the second turning joint J2 is movable with respect to the base part 51. The fastening member may be moved along the slit 517.

The rear end 72 of the link 70 may be located on the bottom surface of the base part 51. A washer 78 (see FIG. 4) may be disposed on the upper surface of the base part 51. The fastening member may be fastened to the washer 78 through the slit 57 and the fastening hole.

In the state in which the door 3*c* is closed, the rear end 72 of the link 70 is located at the initial position (see FIG. 10*a*). At the initial position, the rear end 72 of the link 70 may be spaced apart from the front end of the slit 517 by a predetermined distance. Specifically, the rear end 72 of the link 70 abuts the rear end of the slit 517.

When the door 3*c* starts to be opened in the state in which the door 3*c* is closed, the rear end 72 of the link 70 moves along the slit 517 until the opening angle of the door 3*c* reaches a predetermined withdrawal start angle θ (see FIG. 10*b*). At this time, the base part 51 may remain stationary. That is, the drawers D1, D2, and D3 do not move until the opening angle of the door 3*c* reaches a predetermined withdrawal start angle θ.

The withdrawal start angle θ is the opening angle of the door 3*c* until the rear end 72 of the link 70 or the second turning joint J2 moves from the initial position (i.e. the position in the state in which the door 3*c* is closed) to the front end of the slit 517. As the opening angle of the door 3*c* exceeds the withdrawal start angle θ, the second turning joint J2 moves together with the base part 51, and the drawers D1, D2, and D3 are moved forward (i.e. withdrawn). While the second turning joint J2 moves from the initial position to the front end of the slit 517, the door 3*c* is turned, but the drawers D1, D2, and D3 or the base part 51 is not moved. Consequently, a section in which the door 3*c* is opened while being turned from the state in which the door 3*c* is closed to the withdrawal start angle θ is defined as a withdrawal delay section.

The withdrawal delay section is necessary to prevent the drawers D1, D2, and D3 from colliding with the rear surface of the door 3*c* or the elements installed at the rear surface of the door 3*c* (e.g. the door storage unit 8*a*, 8*b*, and 8*c*). That is, if the withdrawal delay section is not provided, the drawers D1, D2, and D3 move immediately when the door 3*c* starts to be opened in the state in which the door 3*c* is closed, with the result that the drawers D1, D2, and D3 move forward before the rear surface of the door 3*c* or the protruding structure, such as the door storage unit 8*a*, 8*b*, and 8*c*, installed on the rear surface of the door 3*c* deviates from the movement paths of the drawers D1, D2, and D3, whereby the drawers D1, D2, and D3 may collide with the rear surface of the door 3*c* (or the protruding structure).

The withdrawal start angle θ may be 90 degrees or less, preferably 70 to 80 degrees. If the distance that the base part 51 is moved until the door 3*c* is fully opened from the withdrawal start angle θ is defined as a withdrawal distance, the withdrawal distance may be set to about 10 cm.

When the door 3*c* is turned to the withdrawal start angle θ, the rear end 72 of the link 72 is located at the front end of the slit 517. Consequently, the base part 51 is moved, with the result that the drawers D1, D2, and D3 are also moved.

The drawers D1, D2, and D3 do not pass over the front surface S(f) of the storage compartment S3 even in the state in which the drawers D1, D2, and D3 are moved by the withdrawal distance. However, the movable range of the drawers D1, D2, and D3 that is allowed by the drawer guides 40 is not limited such that the drawers D1, D2, and D3 do not pass over the front surface S(f) of the storage compartment S3. That is, the drawers D1, D2, and D3 are located at positions where the drawers D1, D2, and D3 do not pass over the front surface S(f) of the storage compartment S3 even in the state in which the door 3*c* is fully open. However, this means that the drawers D1, D2, and D3 are automatically withdrawn to the final positions thereof by the withdrawal mechanism 50*a*. In other embodiments, the user may further withdraw the drawers D1, D2, and D3 manually. To this end, the drawer guides 40 may be configured to guide the movement of the drawers D1, D2, and D3 such that the drawers D1, D2, and D3 pass over the distance to which the drawers D1, D2, and D3 are automatically withdrawn by the withdrawal mechanism 50*a*.

The link 70 may include a first bent section 73 extending from the front end 71 and bent convexly in the direction away from the turning axis C of the door 3*c* and a second bent section 74 located between the first bent section 73 and the rear end 72 and bent convexly in the direction opposite the first bent section 73.

Since the front end 71 of the link 70 is spaced apart from the turning axis C of the door 3*c*, a portion of the door 3*c*, particularly a part of the door 3*c* between the turning axis C and the front end 71 (e.g. a corner of the door 3*c*), may interfere with the link 70 when the door 3*c* is turned. it is necessary to solve this problem in the case in which the front end 71 of the link 70 is connected to the door 3*c* at a position at which the front end 71 of the link 70 is spaced apart upward from the bottom surface of the door 3*c* by a predetermined distance or in the case in which the link 70 is formed so as to be bent in the upward-downward direction even though the link 70 is coupled to the bottom surface of the door 3*c*. In order to solve this problem, the link 70 includes a first bent section 73 extending from the front end 71 and bent convexly in the direction away from the turning axis C of the door 3*c*.

If the first bent section 73 is formed over the entirety of the link 70, it is easy to avoid interference between the door 3*c* and the link 70. Since the first bent section 73 is convex, however, it is difficult to configure the link 70 such that the link is hidden by the door 3*c* or the base part 51 during the opening and closing operation of the door 3*c*. In addition, it is also difficult to space the second turning joint J2 apart from the turning axis C of the door 3*c*. For this reason, the second bent section 74, which is convex in the direction opposite the direction in which the first bent section 73 is convex, is provided between the first bent section 73 and the rear end 72 of the link.

FIG. 11 is a view partially showing a refrigerator according to another embodiment of the present invention. In FIG. 11, a drawer guide 40 is schematically shown for the reason that if the entire structure thereof were shown, the figure would become complicated, which would make it difficult to understand the present invention. Consequently, it should be understood that the drawer guide 40 shown in FIG. 11 is identical to that described in the previous embodiment.

At least one drawer is disposed in a storage compartment S3. The drawer is supported by drawer guides 40. In FIG. 11, one drawer D1 is shown. In the following description, however, it is assumed that three drawers D1, D2, and D3 (see FIG. 4) are disposed, in the same manner as in the previous embodiment.

A withdrawal mechanism 50*b* is substantially identical in construction, to the withdrawal mechanism 50*a* of the previous embodiment except for a connection bar 53*b*. A structure in which the withdrawal mechanism 50*b* is interlocked with a door 3*c* via a link 70 is identical to the structure in the previous embodiment. In addition, the withdrawal mechanism 50*b* may be moved by a driving means, such as an electric motor or an electric actuator.

Catching protrusions 330 may protrude from the drawers D1, D2, and D3 toward side surfaces S(s) of the storage compartment S3. The catching protrusions 330 may protrude from opposite side surfaces 325 and 326 of the drawers D1, D2, and D3. In the case in which each of the drawers D1, D2, and D3 is a container 320, as in this embodiment, the width of a storage space in the container 320 is dictated by the opposite side surfaces 325 and 326. In the case in which each of the drawers D1, D2, and D3 is a shelf 310 (see FIG. 2), as in other embodiments, the catching protrusions 330 may protrude from side surfaces 325 and 326 of the shelf 310. In this case, the side surfaces of the shelf 310 may be defined as opposite edges of the shelf 310, which dictates the width of the shelf 310.

The withdrawal mechanism 50*b* may include arms 532 and 533 extending forward from a rear frame 52 so as to be located between the drawers D1, D2, and D3 and the side surfaces S(s) of the storage compartment S3. The arms 532 and 533 may be configured similarly to those of the withdrawal mechanism 50*a* according to the previous embodiment except that the arms 532 and 533 are provided with protrusion connection holes 532*a* and 533*a*, into which the catching protrusions 330 are inserted.

The catching protrusions 330 protruding from the drawer D1 are inserted into the protrusion connection holes 532*a* and 533*a*. Consequently, the drawer D1 may be moved by the withdrawal mechanism 50*b* not only when the withdrawal mechanism 50*b* is moved forward but also when the withdrawal mechanism 50*b* is moved rearward. That is, in the structure in which the catching protrusions 330 are connected to the protrusion connection holes 532*a* and 533*a*, the withdrawal mechanism 50*b*, which is moved rearward when the door 3*c* is closed, pulls the drawer D1 rearward. Consequently, the drawer D1 may automatically return to the original position thereof in response to the closing operation of the door 3*c*. At this time, however, force for returning the drawer D1 is not applied only by the withdrawal mechanism 50*b*. The rear surface of the door 3*c* (e.g. the door storage unit 8*a*, 8*b*, and 8*c*; see FIG. 2) may also push the drawers D1, D2, and D3. That is, force applied by the rear surface of the door 3*c* may be added.

The protrusion connection holes 532*a* and 533*a* may extend in the forward-rearward direction (or in the direction in which the drawers D1, D2, and D3 are moved). Consequently, the catching protrusions 330 may be displaced relative to the withdrawal mechanism 50*b* in the protrusion connection holes 532*a* and 533*a*. In the state in which the door 3*c* is closed, the catching protrusions 330 are spaced apart from the rear ends of the protrusion connection holes 532*a* and 533*a*. When the door 3*c* starts to be opened, the withdrawal mechanism 50*b* is moved forward, with the result that the arms 532 and 533 are moved forward. Consequently, the rear ends of the protrusion connection holes 532*a* and 533*a* come into contact with the catching protrusions 330. From this time, the drawers D1, D2, and D3 are moved forward together with the withdrawal mechanism 50*b*. The opening angle of the door 3*c* until the rear ends of the protrusion connection holes 532*a* and 533*a* come into contact with the catching protrusions 330 in the state in which the door 3*c* is closed corresponds to the withdrawal start angle θ.

Meanwhile, the drawer guides 40 may be configured to limit the rearward displacement of the drawers D1, D2, and D3. In this case, when the drawers D1, D2, and D3 are pushed rearward by external force, the drawers D1, D2, and D3 are prevented from moving further rearward, and are stopped at predetermined positions. For example, when moving rails 42 and 43 are moved relative to a stationary rail 41 by a predetermined distance, the stationary rail 41 may restrict further movement of the moving rails 42.

Since the rearward movement of the drawers D1, D2, and D3 is restricted by the drawer guides 40, and the arms 532 and 533 are coupled to the protrusion connection holes 532*a* and 533*a* (i.e. the catching protrusions 330 are inserted into the protrusion connection holes 532*a* and 533*a*), the rear frame 52 is prevented from drooping rearward with respect to a base part 51 even when the drawers D1, D2, and D3 collide with the rear frame 52 as the door 3*c* is closed.

FIG. 12 is a view partially showing a refrigerator according to a further embodiment of the present invention. In the refrigerator according to the embodiment of the present invention shown in FIG. 12, hooks 532*a* and 533*b* may be formed at arms 532 and 533 of a withdrawal mechanism 50*c*. The hooks 532*a* and 533*b* may be configured to be caught by catching protrusions 330. When the withdrawal mechanism 50*c* is moved rearward as the door 3*c* is closed, drawers D1, D2, and D3 are also moved rearward due to the structure in which the hooks 532*a* and 533*b* are caught by catching protrusions 330. Consequently, the drawer D1 may return to the original position thereof. In addition, in the same manner as in the previous embodiments, the rearward movement of the drawers D1, D2, and D3 is restricted by drawer guides 40, and the arms 532 and 533 are coupled to the hooks 532*a* and 533*b* (i.e. the hooks 532*a* and 533*b* are caught by the catching protrusions 330). Consequently, a rear frame 52 is prevented from drooping rearward with respect to a base part 51 even when the drawers D1, D2, and D3 collide with the rear frame 52 as the door 3*c* is closed.

The refrigerator according to this embodiment is substantially identical in construction to the refrigerator according to the previous embodiment shown in FIG. 11 except that the hooks 532*a* and 533*b* are caught by the catching protrusions 330, which protrude from the drawers D1, D2, and D3.

Those skilled in the art to which the present invention pertains will appreciate that the present invention may be carried out in specific ways other than those set forth herein without departing from the spirit and essential characteristics of the present invention. The above embodiments are therefore to be construed in all aspects as illustrative and not restrictive. The scope of the invention should be determined by the appended claims and their legal equivalents, not by the above description, and all changes coming within the meaning and equivalency range of the appended claims are intended to be embraced therein.

The invention claimed is:

1. A refrigerator comprising:

a cabinet with a storage compartment, the storage compartment provided in a front surface of the cabinet with an opening;

a door hinged to the cabinet that is configured to open and close at least a portion of the opening;

a drawer disposed in the storage compartment that is configured to store goods;

a drawer guide that is configured to support the drawer and to guide the drawer to move in a forward-rearward direction; and a withdrawal mechanism comprising a base part disposed at a lower side of the drawer, and a rear frame that is configured to extend from the base part, wherein forward movement of the base part of the withdrawal mechanism by electronic force causes the rear frame of the withdrawal mechanism to contact the drawer and push the drawer forward to withdraw at least partially through the opening in the cabinet based on opening of the door, wherein the withdrawal mechanism is separated from the drawer, and wherein forward movement of the base part of the withdrawal mechanism by electronic force causes the rear frame of the withdrawal mechanism to temporarily achieve contact with the drawer to withdraw the drawer at least partially through the opening in the cabinet.

2. The refrigerator according to claim 1, wherein the withdrawal mechanism comprises an arm that extends forward from the rear frame to be disposed between the drawer and a side surface of the storage compartment.

3. The refrigerator according to claim 2, further comprising an arm guide disposed between the side surface of the storage compartment and the drawer that is configured to guide the arm to move horizontally in the forward-rearward direction.

4. The refrigerator according to claim 3, wherein the withdrawal mechanism comprises a roller rotatably provided at the arm to be guided along the arm guide.

5. The refrigerator according to claim 4, wherein the arm guide comprises a roller guide surface configured to contact the roller at a lower side of roller, the roller guide surface configured to extend in a direction in which the roller is moved.

6. The refrigerator according to claim 5, wherein the arm guide includes a guide groove, which has a section that is open toward the drawer, and the roller is supported by the roller guide surface in the guide groove.

7. The refrigerator according to claim 3, wherein the drawer comprises a plurality of drawers arranged in an upward-downward direction, the rear frame is configured to extend up to a height corresponding to an uppermost one of the drawers, and the arm is disposed between the uppermost drawer and the side surface of the storage compartment.

8. The refrigerator according to claim 3, wherein the arm comprises at least a pair of arms, the arms are disposed between the drawer and opposite side surfaces of the storage compartment, and the arm guide comprises at least a pair of arm guides for guiding the arms.

9. The refrigerator according to claim 7, wherein forward movement of the base part of the withdrawal mechanism by electronic force causes the rear frame of the withdrawal mechanism to contact each of the plurality of drawers and push each of the plurality of drawers forward to withdraw at least partially through the opening in the cabinet.

10. The refrigerator according to claim 1, wherein the rear frame comprises a pair of vertical bars extending upward from the base part which are spaced apart from each other in a width direction of the storage compartment.

11. The refrigerator according to claim 1, wherein the rear frame pushes and moves the drawer without supporting a load of the drawer even when contact between the rear frame and the drawer is temporarily achieved.

12. A refrigerator comprising:

a cabinet with a storage compartment, the storage compartment provided in a front surface of the cabinet with an opening;

a door hinged to the cabinet that is configured to open and close at least a portion of the opening;

a drawer disposed in the storage compartment that is configured to store goods;

a drawer guide that is configured to support the drawer and to guide the drawer to move in a forward-rearward direction; and a withdrawal mechanism comprising a base part disposed at a lower side of the drawer, and a rear frame that is configured to extend from the base part, wherein forward movement of the base part of the withdrawal mechanism by electronic force causes the rear frame of the withdrawal mechanism to contact the drawer and push the drawer forward to withdraw at least partially through the opening in the cabinet based on opening of the door, and wherein the withdrawal mechanism does not support a load of the drawer.

* * * * *